US012752950B2

(12) United States Patent
Leech et al.

(10) Patent No.: US 12,752,950 B2
(45) Date of Patent: Oct. 6, 2026

(54) CONDIMENT PACKAGING APPARATUS, SYSTEMS, AND METHODS

(71) Applicant: H. J. Heinz Company Brands LLC, Pittsburgh, PA (US)

(72) Inventors: Gregg Timothy Francis Leech, Wigan (GB); Kim Bertens-Vlems, Berkel-Enschot (NL); Joseph Elisabeth Oberdorf, Maastricht (NL); Freerk van Oudheusden, Voorhout (NL); Wilfred Teunissen, Utrecht (NL); Martin Steffner, The Hague (NL)

(73) Assignee: H. J. Heinz Company Brands LLC, Pittsburgh, PA (US)

( * ) Notice: Subject to any disclaimer, the term of this patent is extended or adjusted under 35 U.S.C. 154(b) by 5 days.

(21) Appl. No.: 18/606,545

(22) Filed: Mar. 15, 2024

(65) Prior Publication Data

US 2024/0308709 A1 Sep. 19, 2024

Related U.S. Application Data

(60) Provisional application No. 63/452,861, filed on Mar. 17, 2023.

(51) Int. Cl.
*B65B 43/60* (2006.01)
*B65B 7/28* (2006.01)
(Continued)

(52) U.S. Cl.
CPC ..... *B65B 43/60* (2013.01); *B65B 7/2807* (2013.01); *B65B 25/001* (2013.01); *B65B 65/02* (2013.01)

(58) Field of Classification Search
CPC ..... G07F 13/10; B65B 7/2807; B65B 43/50; B65B 43/60; B65B 65/02; B67D 2210/00076
(Continued)

(56) References Cited

U.S. PATENT DOCUMENTS 896,405 A * 8/1908 MacLeod ..... G07F 13/10 221/277
1,555,360 A * 9/1925 Derome ..... B65B 43/50 414/21
(Continued)

FOREIGN PATENT DOCUMENTS

CN 106683279 A 5/2017
CN 207037815 U 2/2018
(Continued)

OTHER PUBLICATIONS

EPO; Application No. 24163879.0; Extended European Search Report issued Jan. 20, 2025.

*Primary Examiner* — Joshua G Kotis
(74) *Attorney, Agent, or Firm* — FITCH EVEN TABIN & FLANNERY LLP

(57) ABSTRACT

A condiment packaging apparatus is provided for dispensing condiment containers. The condiment packaging apparatus includes a condiment receiver for receiving a condiment, a cup dispenser, a ramp, a receptacle, and a turntable. The turntable has a cup receiving portion that receives a cup from the cup dispenser when the cup receiving portion is at the cup dispenser. The turntable is rotatable to transfer the cup to a dispensing outlet where the condiment is dispensed into the cup. The turntable is rotatable to direct the filled cup to the ramp along which the cup slides to the receptacle.

10 Claims, 28 Drawing Sheets

(51) Int. Cl.
*B65B 25/00* (2006.01)
*B65B 65/02* (2006.01)

(58) Field of Classification Search
USPC ..... 53/253; 141/174
See application file for complete search history.

(56) References Cited

U.S. PATENT DOCUMENTS 2,285,279 A * 6/1942 Hohl ..... B65B 43/54 141/315
2,751,134 A * 6/1956 Walldow ..... B65B 43/16 53/385.1
2,860,817 A * 11/1958 Bell ..... B65G 59/102 221/104
2,972,216 A * 2/1961 Schmidt ..... B65B 7/28 221/188
3,010,263 A * 11/1961 Carew ..... B65B 3/06 141/105
3,492,785 A * 2/1970 Mancini ..... B65B 3/32 221/221
3,618,642 A * 11/1971 Beaulieu ..... B65B 43/50 221/176
3,924,384 A * 12/1975 Kinney ..... B65B 7/2807 53/485
3,964,237 A * 6/1976 Johansen ..... B65B 3/027 425/388
4,131,426 A * 12/1978 Range ..... G01N 35/1004 141/130
4,135,347 A * 1/1979 Lowdermilk ..... B65B 43/50 156/212
4,168,599 A * 9/1979 King ..... B65B 7/2807 53/529
4,181,162 A * 1/1980 Newman ..... G07F 13/10 141/105
4,235,840 A * 11/1980 Mendoza ..... G01N 35/1083 422/562
4,282,698 A * 8/1981 Zimmermann ..... B65B 43/44 53/131.5
4,397,133 A 8/1983 Hume
4,516,380 A * 5/1985 Buckner ..... B29C 66/131 53/298
4,862,932 A * 9/1989 Feinstein ..... G01N 1/18 141/130
5,000,345 A 3/1991 Brogna
5,479,969 A * 1/1996 Hardie ..... B65B 3/003 422/549
6,269,837 B1 * 8/2001 Arent ..... B67D 7/0205 251/149.6
7,100,796 B1 * 9/2006 Orr ..... G07F 9/10 141/369
2013/0174520 A1 * 7/2013 Tessier ..... B65B 3/003 141/387
2022/0267135 A1 * 8/2022 Degnan ..... B67B 5/034
2024/0270427 A1 * 8/2024 Thomas ..... B65B 43/50

FOREIGN PATENT DOCUMENTS

CN 109215232 A 1/2019
CN 210133313 U 3/2020
CN 210776953 U 6/2020
CN 111924160 A 11/2020
CN 110353480 B 3/2021
CN 112802267 A 5/2021
CN 106781038 B 3/2022
CN 114890362 A 8/2022
WO 1990006885 A1 6/1990
WO 2022182901 A1 9/2022

* cited by examiner

CONDIMENT PACKAGING APPARATUS, SYSTEMS, AND METHODS

CROSS-REFERENCE TO RELATED APPLICATIONS

This application claims benefit of U.S. Provisional Application No. 63/452,861, filed Mar. 17, 2023, which is incorporated herein by reference in its entirety.

FIELD

This disclosure relates to packaging devices and, in particular, to condiment packaging devices.

BACKGROUND

Restaurants often provide customers with one or more condiments for their food items. These condiments include, as examples, ketchup, mustard, mayonnaise, and barbeque sauce, as well as other condiments including particulate. Some restaurants provide large containers of one or more condiments along with a hand pump that is actuated to dispense the condiment into a container to use with their food. One such container is a paper cup that does not include a lid and thus cannot be easily transported with food, for example, in a to-go bag. Other types of containers include a plastic cup with a removable plastic lid. Such plastic cups can be safely transported with food items but are not compostable. Use of these types of containers also requires restaurant staff or the customer to manually fill and close the containers upon the customer placing an order.

Some restaurants provide sealed sachets or dip pots filled with condiment, however, these sealed sachets or dip pots are often formed of a plastic and/or foil material that is not biodegradable. Biodegradable materials generally have not been used for sachets or dip pots because the shelf life is too short to be filled at a manufacturing facility, distributed to restaurants, and provided to customers to use with their food.

DETAILED DESCRIPTION

Figure 1:
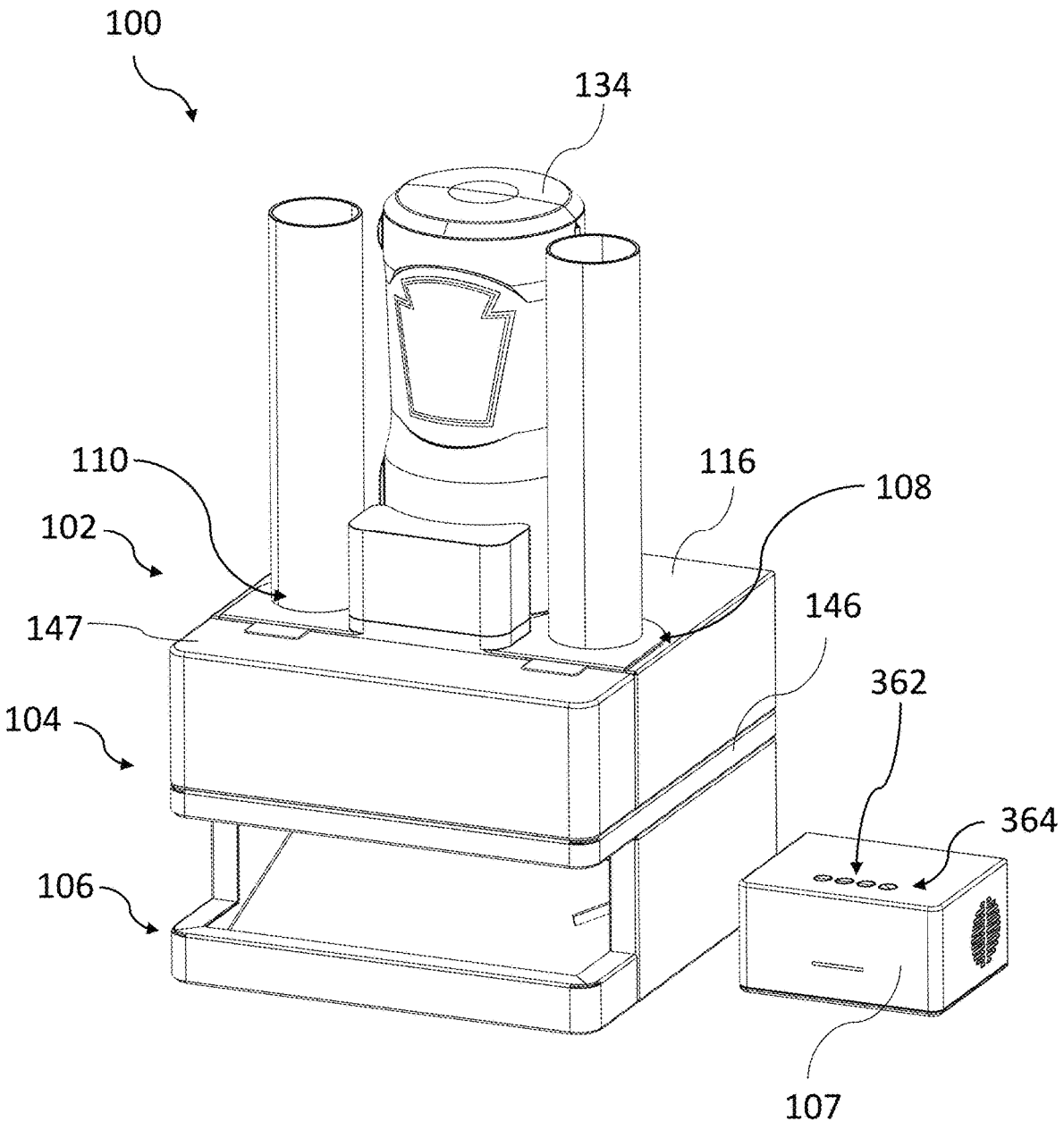
FIG. 1 is a perspective view of a condiment packaging apparatus.
Figure 2:
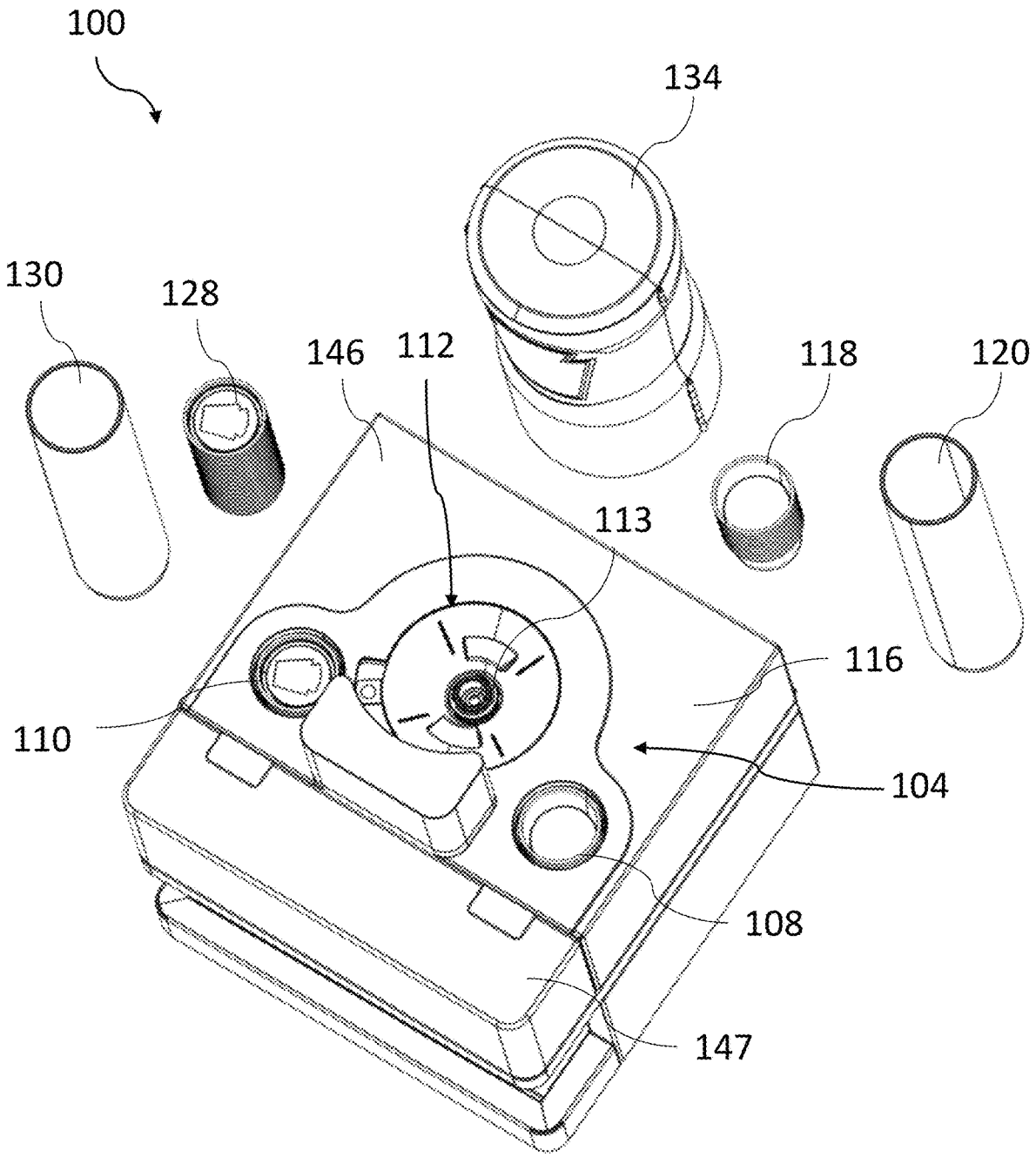
FIG. 2 is a perspective view of the condiment packaging apparatus of FIG. 1 illustrating that cups, lids, and a condiment cartridge may be loaded into a loading portion of the condiment packaging apparatus.
Figure 3:
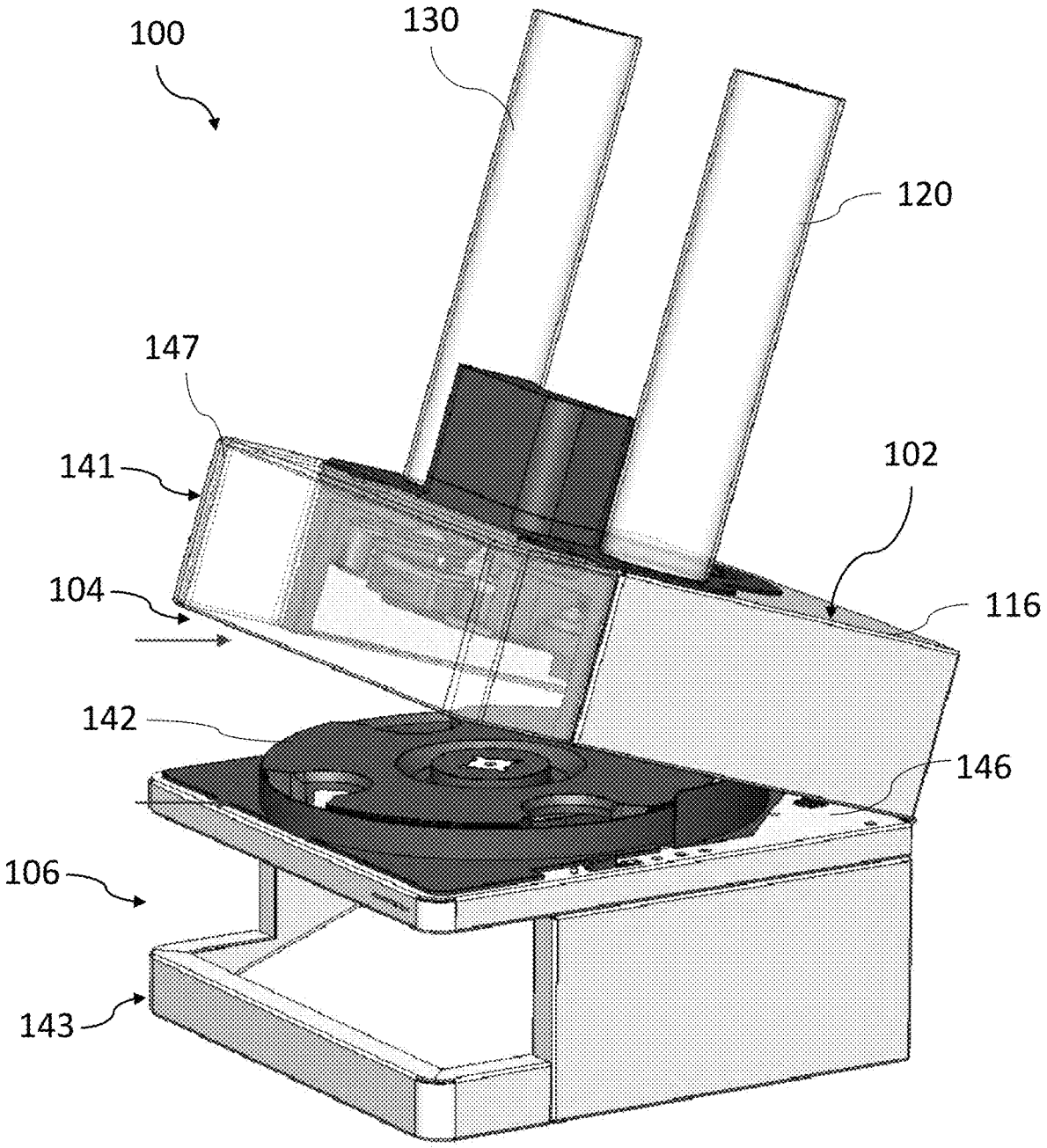
FIG. 3 is a perspective view of the condiment packaging apparatus of FIG. 1 illustrating an upper portion pivoted from a lower portion of the condiment packaging apparatus.

With respect to FIGS. 1-3, a condiment packaging apparatus 100 is provided. The condiment packaging apparatus 100 receives cups, lids and condiment and dispenses cups filled with condiment and closed with a lid which will be referred to herein as a closed condiment container. The closed condiment containers may be provided to customers along with their food order. For example, the closed condiment containers may be placed in a to-go bag for the customer to take on the go. The condiment packaging apparatus 100 is able to automatically make the closed condiment containers which restaurant staff are able to grab and provide to the customer. This saves the restaurant staff time in that they do no need to spend time manually filling and closing the cups.

Additionally, the cups and lids may be made of compostable materials (e.g., paper, bagasse, bamboo) that are readily decomposable once used. Typically, condiment is often provided in packaging that is not compostable or at least not easily compostable, such as plastic cups and sachets made from plastic and/or foil. Compostable materials often are not used because compostable packaging materials often have a limited shelf life. For example, the water content, acidity, and other properties of the condiment may cause at least a portion of the packaging to degrade over time. Thus, to ensure that the condiment of the closed condiment container is usable when provided to a customer, the condiment packaging apparatus 100 may be used to fill the condiment cups at the restaurant, for example, in the kitchen. The condiment packaging apparatus 100 thus enables closed condiment containers to be made at the restaurant so that condiment is able to be distributed to customers within the shelf life of the closed condiment container (having just been made before being given to the customer) while mitigating the impact on the environment.

The condiment packaging apparatus 100 includes a loading portion 102, a packaging portion 104, and a receptacle portion 106. The loading portion 102, packaging portion 104, and receptacle portion 106 may be stacked upon one another to minimize the footprint or area of the base of the condiment packaging apparatus 100 and thus the amount of countertop space required for the condiment packaging apparatus 100. As shown, the loading portion 102 is vertically above the packaging portion 104, and the packaging portion 104 is vertically above the receptacle portion 106. The condiment packaging apparatus 100 may also include a control box 107 that includes components to control the operation of the condiment packaging apparatus 100 as discussed below. However, it should be appreciated that the control box or other control features may be incorporated into the other portions discussed above.

The loading portion 102 includes a cup receiver 108, a lid receiver 110, and a cartridge receiver 112. The cup receiver 108 may include an opening in a top cover 116 of the condiment packaging apparatus 100 into which cups 118 may be inserted into the condiment packaging apparatus 100. The cup receiver 108 may include a loading tube 120 that is removably connected to the top cover 116 and aligned with the opening. A stack of cups 118 may be inserted into the loading tube 120. The loading tube 120 may guide the cups 118 toward the opening and support the stack of cups 118 (e.g., keep the stack of cups 118 from tipping over). The loading tube 120 thus permits a greater number of cups 118 to be loaded into the condiment packaging apparatus 100 so that the cups 118 do not need to be refilled as frequently. The cups 118 travel through the opening to a cup dispenser 122 which takes one cup 118 at a time from the cup receiver 108 (e.g., separates a cup 118 from the stack of cups 118) and dispenses the cup 118 to a cup receiving portion or notch 148 of the packaging portion 104 discussed in further detail below.

The lid receiver 110 may include an opening in the top cover 116 of the condiment packaging apparatus 100 into which lids 128 may be inserted into the condiment packaging apparatus 100. The lid receiver 110 may include a loading tube 130 that is removably connected to the top cover 116 and aligned with the opening. A stack of lids 128 may be inserted into the loading tube 130. The loading tube 130 may guide the lids 128 toward the opening and support the stack of lids 128 (e.g., keep the stack of lids 128 from tipping over). The loading tube 130 thus permits a greater number of lids 128 to be loaded into the condiment packaging apparatus 100 so that the lids 128 do not need to be refilled as frequently. The lids 128 travel through the opening to a lid dispenser 132 which takes one lid 128 at a time from the lid receiver 110 (e.g., separates a lid 128 from the stack of lids 128) and dispenses the lid 128 to a cup 118 of the packaging portion 104 discussed in further detail below.

The cartridge receiver 112 includes a cartridge inlet 113 to which a condiment cartridge 134 may be mounted and connected to a fluid transfer system 136 of the condiment packaging apparatus 100. The cartridge 134 may be removably secured to the cartridge inlet 113 to support the cartridge 134 in an upright position. An outlet 138 of the cartridge 134 (see FIG. 9) may connect directly to an inlet 140 of the fluid transfer system 136. The fluid transfer system 136 may be operated as discussed in further detail below to draw condiment from the condiment cartridge 134 and dispense the condiment into a cup 118.

With respect to FIGS. 3-5D, the packaging portion 104 includes a turntable 142, the cup dispenser 122, lid dispenser 132, fluid transfer system 136, and a lid presser 144. Regarding FIG. 3, an upper portion 141 of the condiment packaging apparatus 100 including the loading portion 102 and at least a portion of the packaging portion 104 (e.g., the cup dispenser 122, lid dispenser 132, and fluid transfer system 136) may be pivoted from a lower portion 143 of the condiment packaging apparatus 100. For example, the upper portion 141 may be connected to the lower portion 143 by a hinge. The upper portion 141 may be lifted upward and pivoted from the lower portion 143 to provide access to the packaging portion 104, for example, to the turntable 142. Providing access to the turntable 142 permits the turntable 142 to be cleaned and/or removed from the condiment packaging apparatus 100. The upper portion 141 may include an access cover 147 that is hingedly connected to the top cover 116. The access cover may be pivoted upward to provide access to the turntable 142 and/or fluid transfer system 136 without lifting the entire upper portion 141. For example, the access cover 147 may be pivoted upward to withdraw the fluid transfer system 136 from the upper portion 141, for example, for cleaning. The access cover 147 may be made of a transparent material (e.g., a plastic) so that the operation of the condiment packaging apparatus 100 may be visually monitored while the access cover 147 is closed.

Figure 4A:
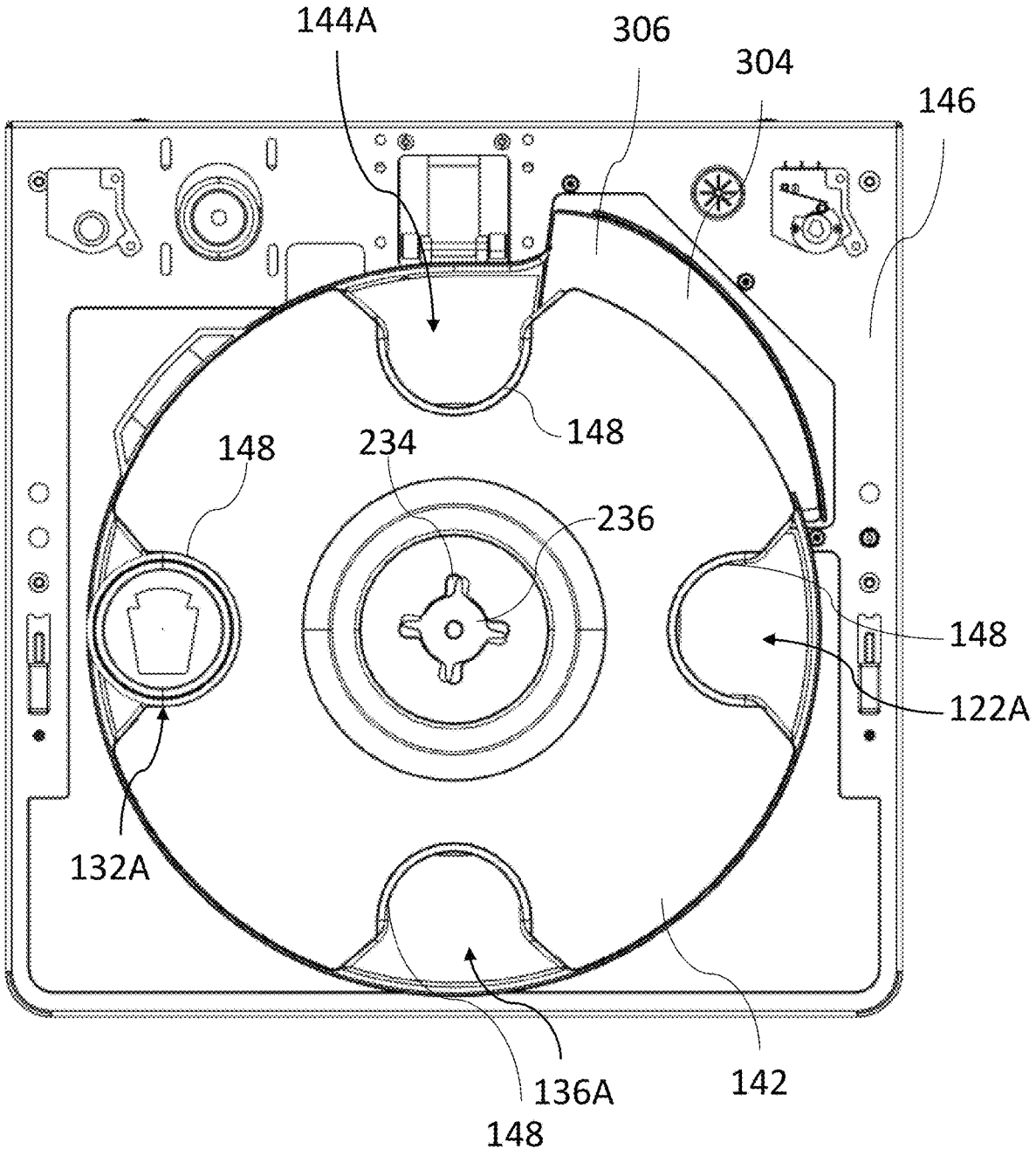
FIG. 4A is a top view of a turntable of the condiment packaging apparatus of FIG. 1 mounted in the packaging portion of the condiment packaging apparatus.
Figure 4B:
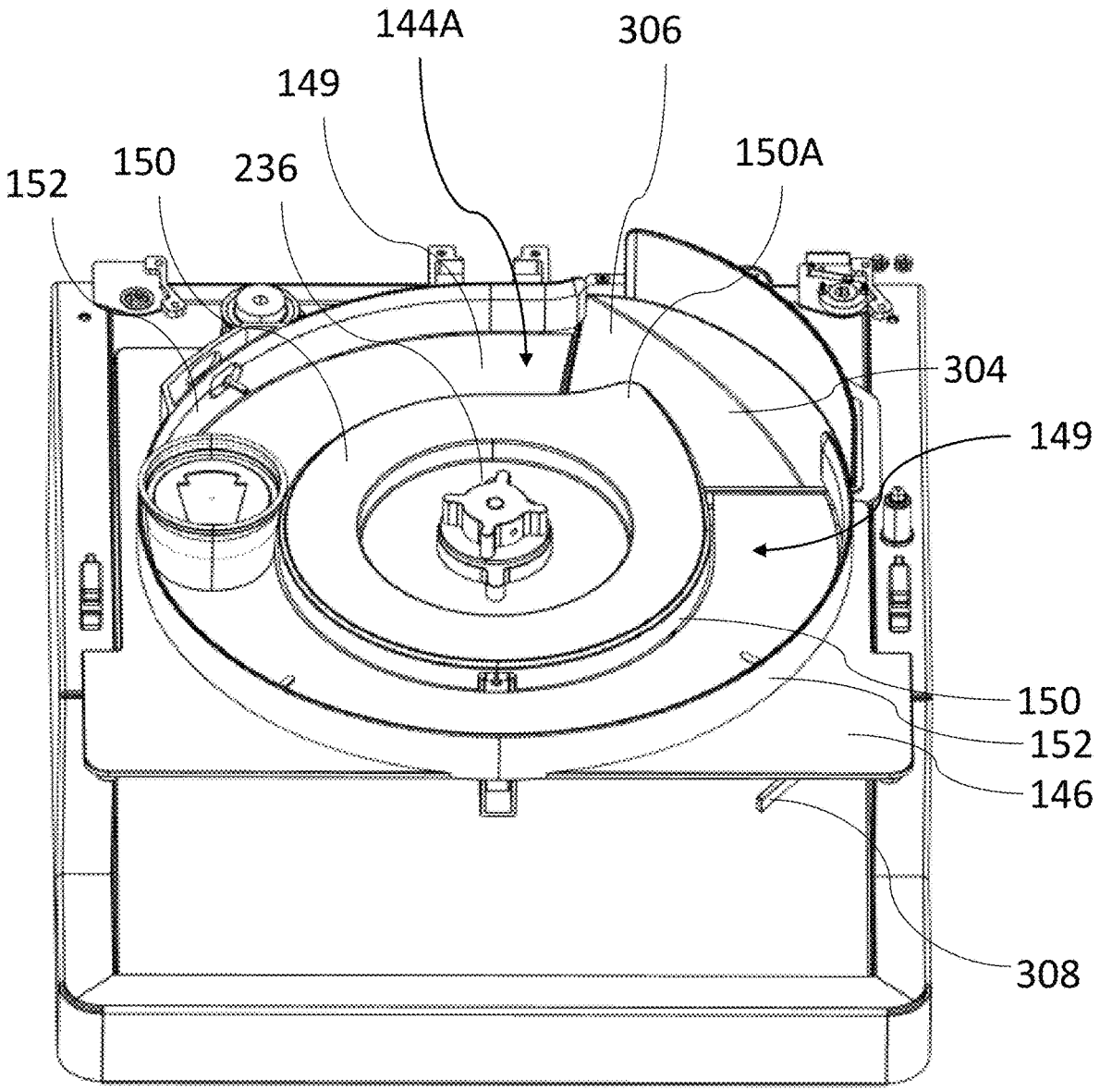
FIG. 4B is a front perspective view of a portion of the condiment packaging apparatus of FIG. 1 illustrating a track along which a cup travels to be filled, closed, and dispensed.

Regarding FIGS. 4A-4B, the turntable 142 is rotatable relative to a platform 146 of the packaging portion 104. The turntable 142 includes one or more notches 148 that are configured to receive a cup 118. The notches 148 engage a cup 118 positioned within the notch 148 to push the cup 118 along the platform 146. The platform 146 may define a loop or track 149 that the cup 118 may slide along as the turntable 142 is rotated. The track 149 may include one or more inner guide walls 150 and one or more outer guide walls 152 that guide the cup 118 as the turntable 142 pushes the cup 118 along the track 149.

Figure 5A:
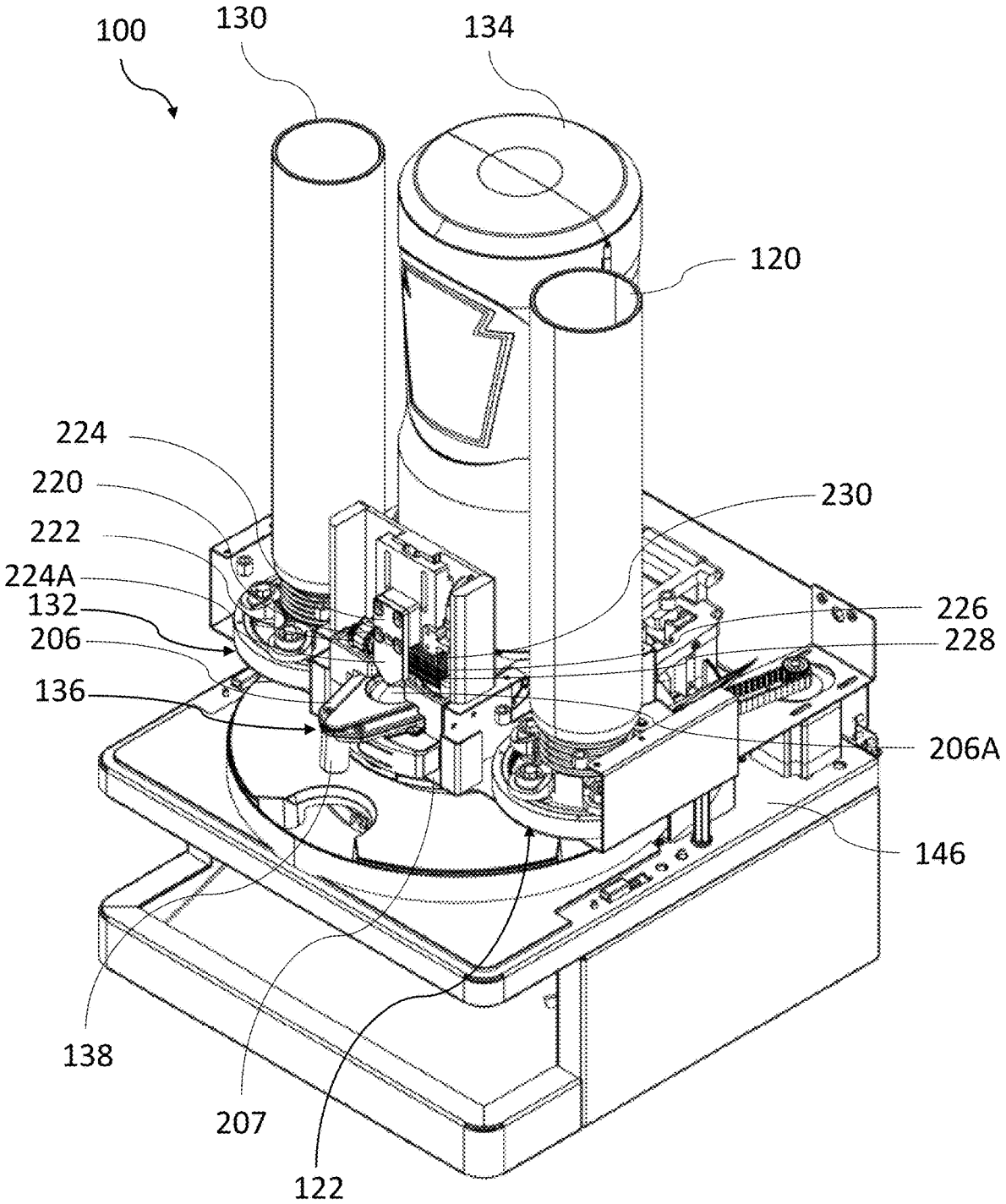
FIG. 5A is a top perspective view of the condiment packaging apparatus of FIG. 1 shown without top covers.
Figure 5B:
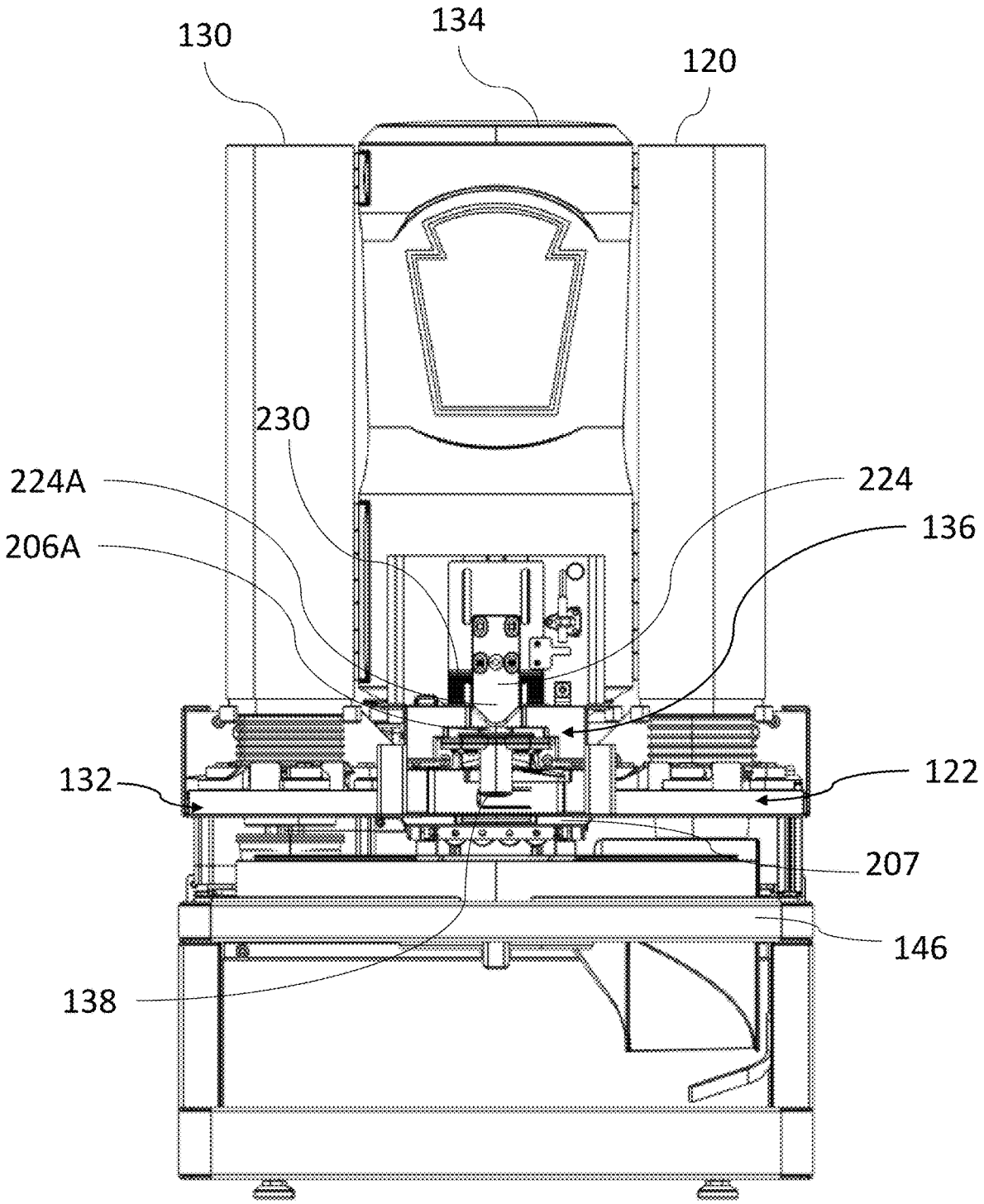
FIG. 5B is a front elevation view of the condiment packaging apparatus of FIG. 1 shown without top covers.

Regarding FIGS. 5A-5D, the condiment packaging apparatus 100 may include four stations (see FIG. 5C): a cup dispensing station 122A, a filling station 136A, a lid dispensing station 132A, and a lid pressing station 144A. The turntable 142 may be rotated to bring the cups 118 positioned in the notches 148 in the loop from station to station. As seen in FIG. 5B, the cup dispenser 122 is positioned above the turntable 142 at the cup dispensing station 122A and configured to drop a cup 118 from the cup receiver 108 into a notch 148 of the turntable 142 when the notch 148 is positioned below the cup dispenser 122. The fluid transfer system 136 has an outlet 138 positioned above the turntable 142 at the filling station 136A. The fluid transfer system 136 may be operated to dispense condiment from the outlet 138 and into the cup 118 to fill the cup 118 with condiment when the cup 118 is positioned below the outlet 138. The lid dispenser 132 is positioned above the turntable 142 at the lid dispensing station 132A and configured to drop a lid 128 from the lid receiver 110 onto the a cup 118 when the cup 118 is positioned below the lid dispenser 132. The lid presser 144 (see FIGS. 5D and 10) has a pressing arm 156 positioned above the turntable 142 at the lid pressing station 144A. The lid presser 144 is operable to press a lid 128 onto a cup 118 when the cup 118 and lid 128 are positioned below the pressing arm 156 as discussed in further detail below.

Figure 6A:
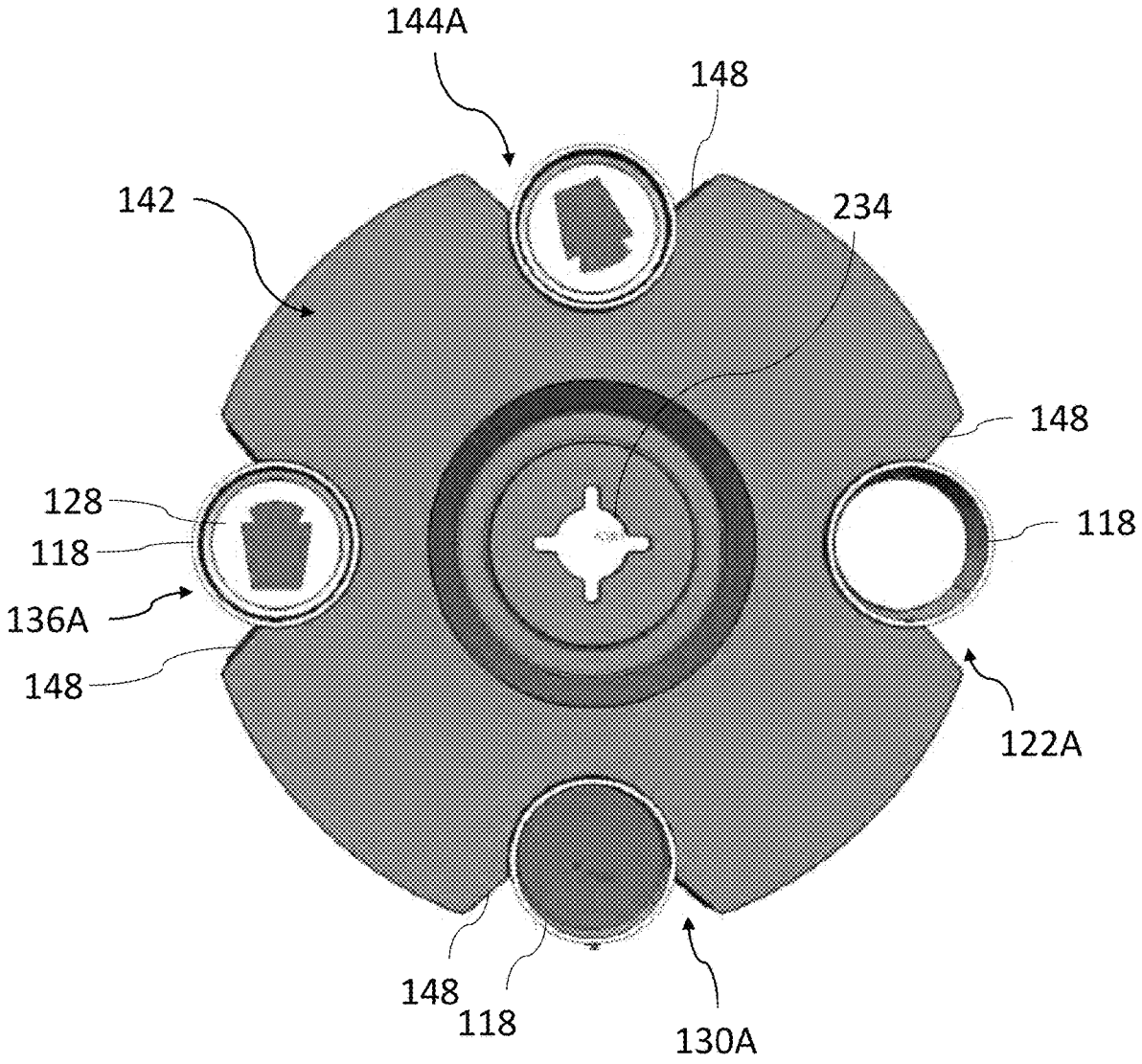
FIG. 6A-6C illustrate rotation of the turntable between packaging stations of the condiment packaging apparatus of FIG. 1.
Figure 6B:
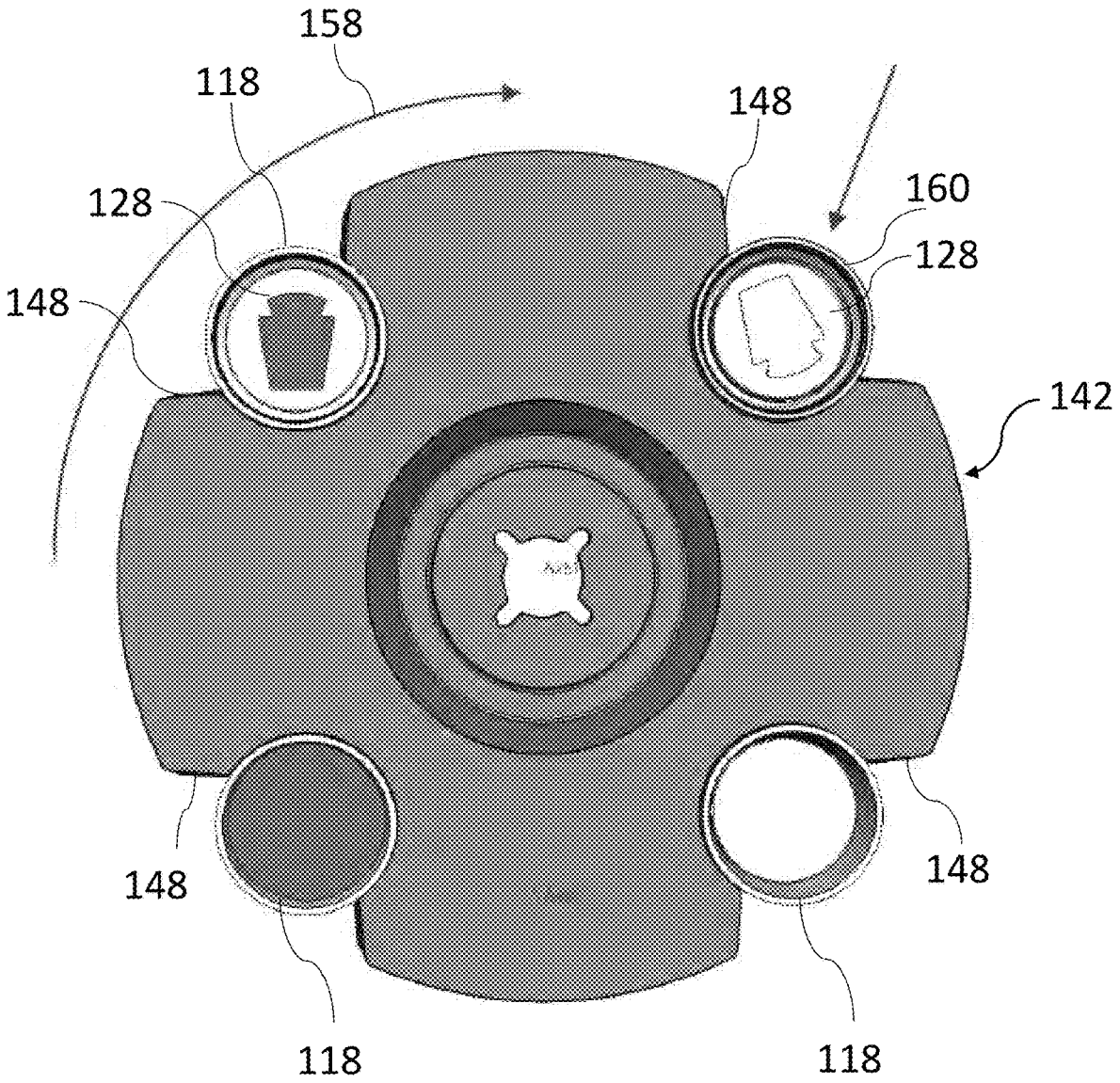
Figure 6C:
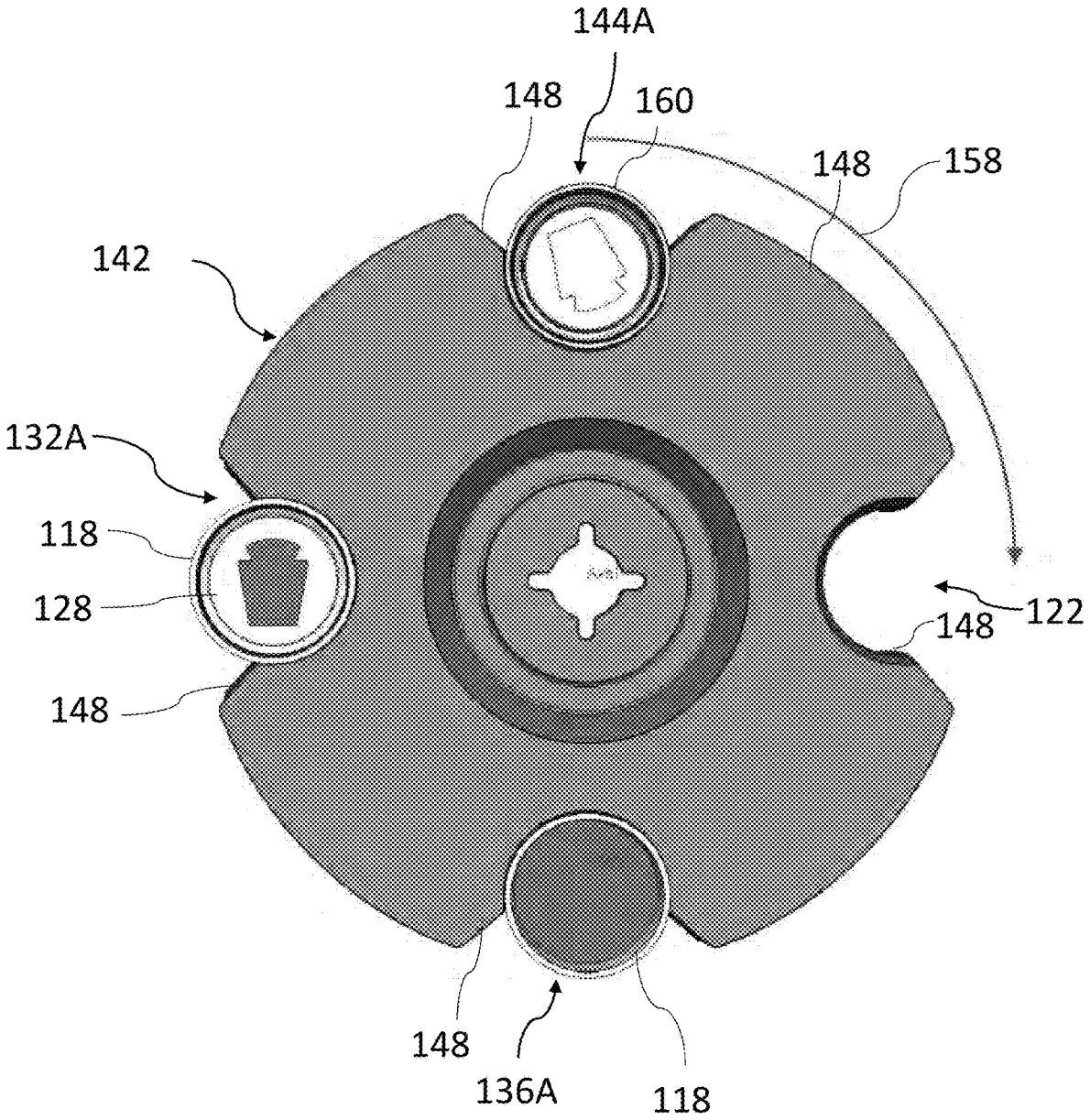

With respect to FIGS. 6A-6C, in one approach, the turntable 142 may include four notches 148 that may each be positioned at one of the above stations at the same time. The turntable may be rotated to bring the notches from station to station in a loop to form the closed condiment containers 160. With respect to FIG. 6A, a notch 148 at the cup dispensing station 122A may receive a cup 118 from the cup dispenser 122, a cup in the notch 148 at the filling station 136A may be filled with condiment from the outlet 138 of the fluid transfer system 136, a cup 118 in the notch 148 at the lid dispensing station 132A may receive a lid 128, and a lid 128 on the cup 118 at the lid pressing station 144A may be pressed onto the cup 118. These steps may be performed at substantially the same time while the turntable 142 is in the position shown. With respect to FIG. 6B, once these steps are complete, the turntable 142 may be rotated (e.g., by a motor as discussed below) in direction 158 to move the notches 148 to the next station shown in FIG. 6C. Rotation of the turntable 142 brings the empty cup 118 to the filling station 136A to be filled with condiment, the filled cup 118 to the lid dispensing station 132A to receive a lid 128, the cup 118 with the lid 128 to the lid pressing station 144A to have the lid 128 pressed onto the cup 118, and ejects a closed condiment container 160 to the receptacle portion 106 as described below such that the notch 148 is empty and ready to receive another empty cup 118 (see FIG. 6C). This cycle may continue until the desired amount of closed condiment containers 160 are made, the cup receiver 108 runs out of cups, the lid receiver 110 runs out of lids, and/or the condiment cartridge 134 runs out of condiment. In other forms, the turntable 142 may include additional or fewer notches 148 and some notches 148 may be between stations while other notches are at the stations.

Figure 7:
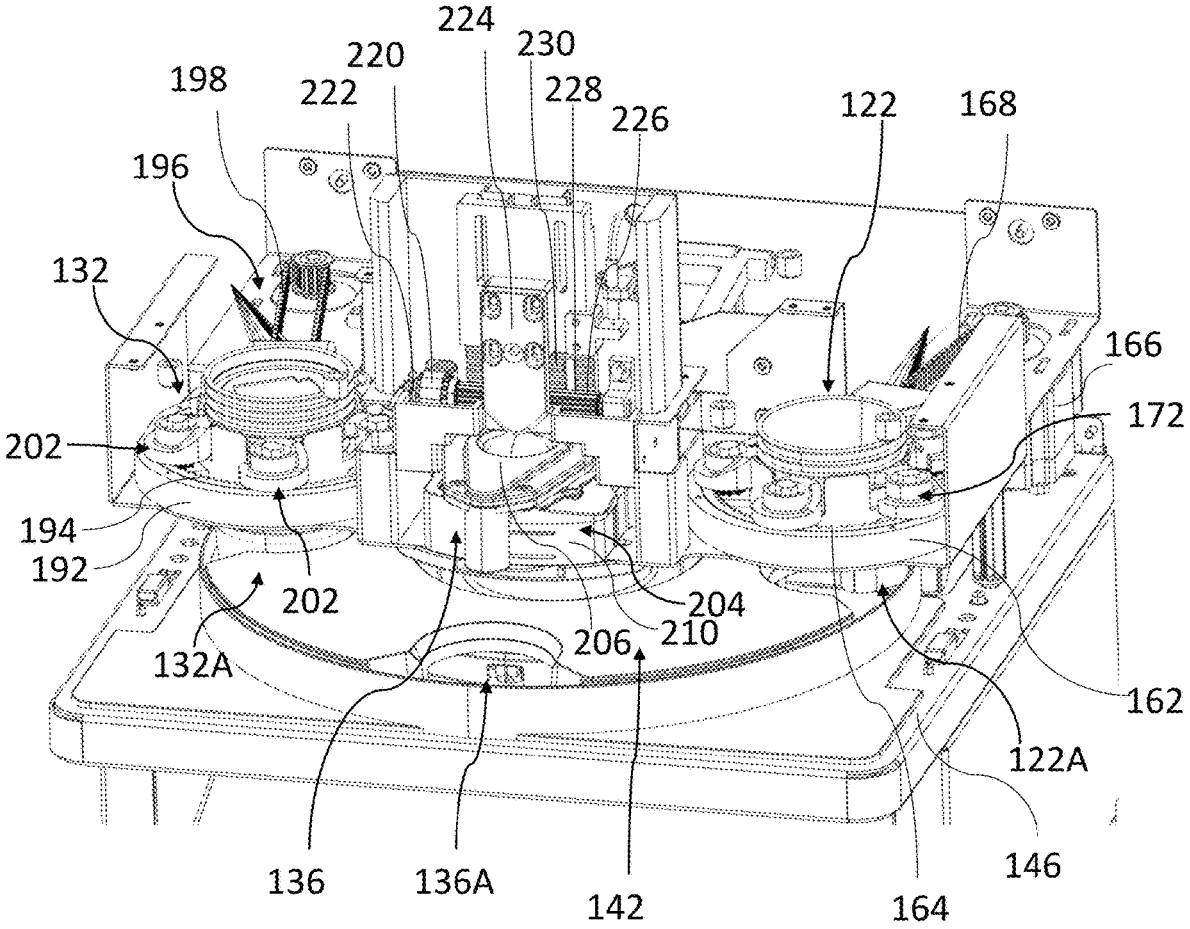
FIG. 7 is a front perspective view of the cup dispenser, fluid transfer system, and lid dispenser of the condiment packaging apparatus of FIG. 1.

With respect to FIG. 7, portions of the condiment packaging apparatus 100 are removed to show the cup dispenser 122, lid dispenser 132, and fluid transfer system 136. With respect to FIGS. 7-8B, the cup dispenser 122 includes a disc 162, a gearwheel 164, a motor 166, a belt 168, a gear 170, and one or more screw members 172. The disc 162 supports the gearwheel 164 such that the gearwheel 164 that is able to rotate within a disc 162. The motor 166 may be operated to drive the belt 168 which turns the gear 170. The gear 170 includes teeth that engage corresponding teach of the gearwheel 164. Thus, when the motor 166 turns, the belt 168 turns the gear 170 which turns the gearwheel 164.

Figure 8A:
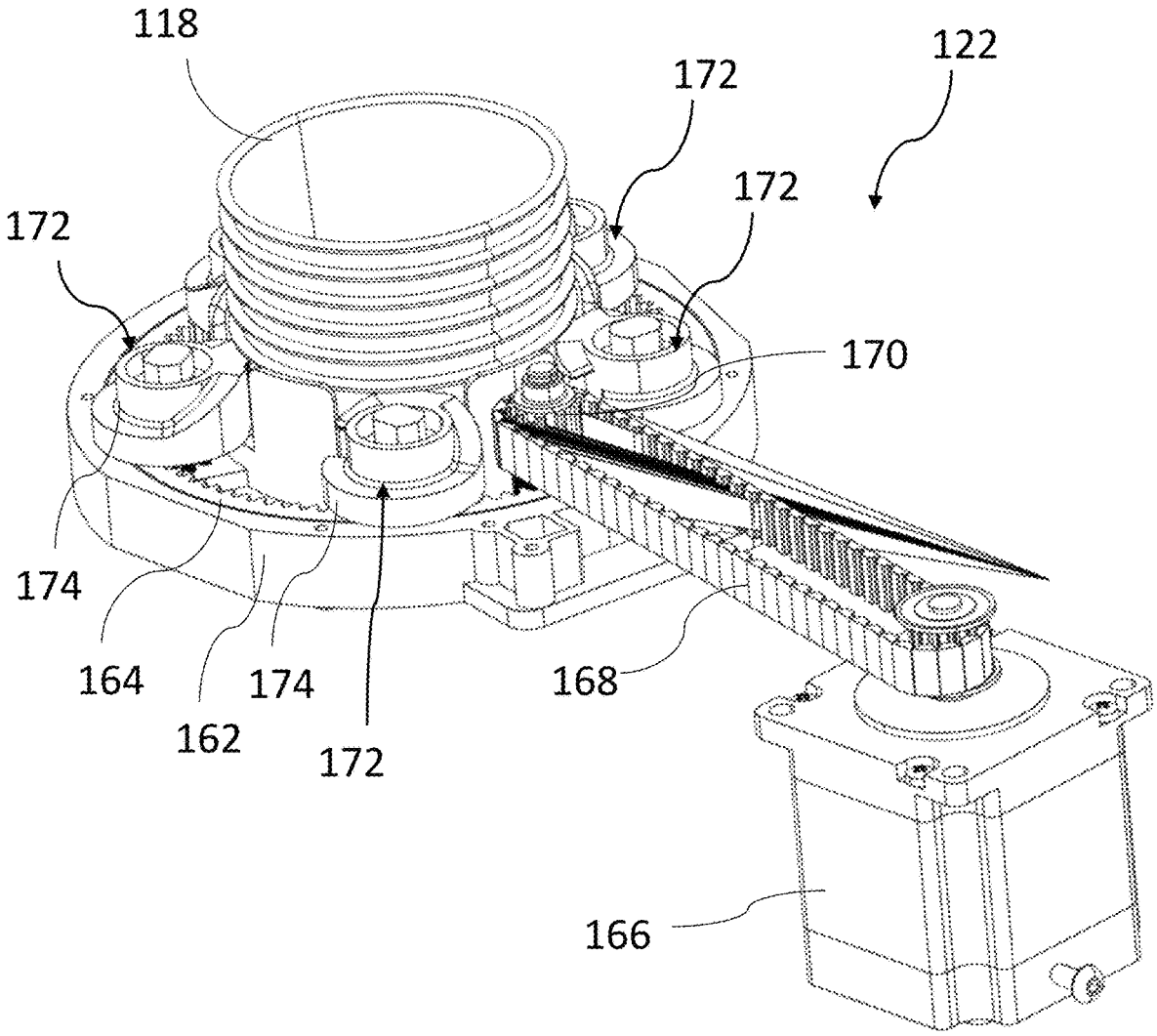
FIG. 8A is a perspective view of a cup dispenser of the condiment packaging apparatus of FIG. 1.
Figure 8B:
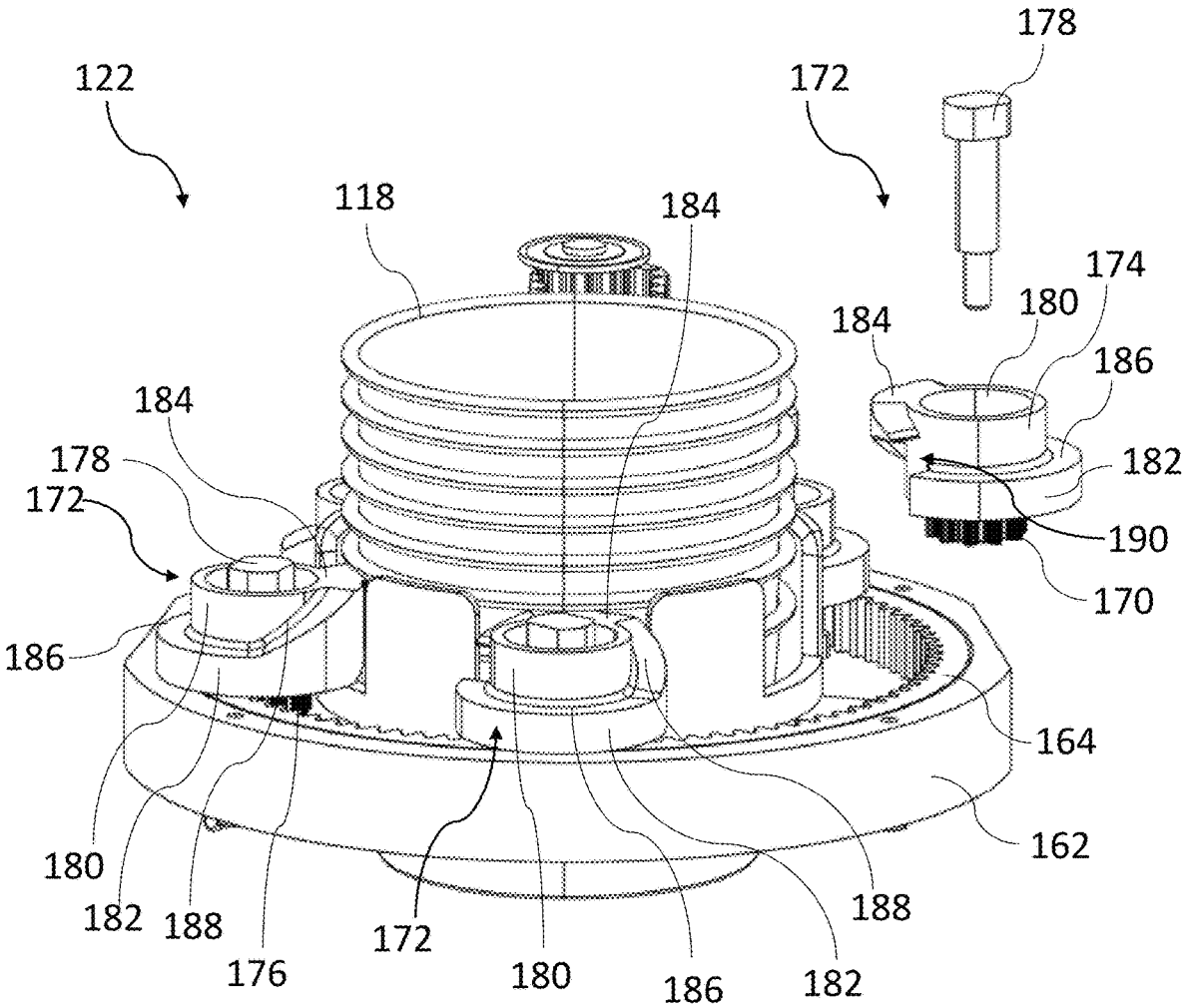
FIG. 8B is a perspective, partially exploded view of the cup dispenser of FIG. 8A.

With reference to FIGS. 8A-8B, the screw members 172 each include a body 174 and a gear 176. The body 174 and the gear 176 may be coupled to a shaft 178. The gear 176 includes teeth that engage the teeth of the gearwheel 164 such that rotation of the gearwheel 164 rotates the shaft 178 and the body 174. The body 174 includes a central cylindrical portion 180 and a thread or ledge portion 182 (similar to threads of a screw) that extends radially outward from the cylindrical portion 180. The ledge portion 182 may have an upper segment 184 and a lower segment 186 connected on one side by a sloped segment 188. The other side of the upper segment 184 and lower segment 186 are disconnected being separated by a gap 190. A rim of a cup may rest on the ledge portion 182 and inhibit the cup from passing through the disc 162. Rotation of the gearwheel 164 by the motor 166 causes the body 174 to rotate. Rotation of the body 174 causes the rim of the cup to travel from the upper segment 184 of the ledge portion 182 to the lower segment 186 along the sloped segment 188. As the body 174 continues to rotate, the rim of the cup travels passed a terminal end of the lower segment 186 through the gap 190. With the rim of the cup passed the end of the lower segment 186 and below the upper segment 184, the rim of the cup is no longer supported by the ledge portion 182 of the body 174 and the cup is thus able to fall from the cup dispenser 122 to the notch 148 of the turntable 142. The upper segment 184, however, is now below the rim of the next cup in the stack which inhibits the next cup from also falling to the turntable 142. The cup dispenser 122 is thus able to separate the cups from the stack of cups and dispense a single cup at a time until all the cups in the stack have been dispensed.

The cup dispenser 122 may further include a sensor (e.g., a proximity sensor) that is used to detect whether there are any more cups in the stack of cups. Upon determining there are no more cups in the cup receiver 108, the condiment packaging apparatus 100 may provide a notification that the cups need to be refilled. For example, the condiment packaging apparatus 100 may include an indicator light (e.g., an LED) that is illuminated and/or flashes when the cups need to be refilled. The condiment packaging apparatus 100 may also send an alert to a remote computer, for example, a cash register or smartphone running an app, to alert the staff that the cups need to be refilled.

Figure 5C:
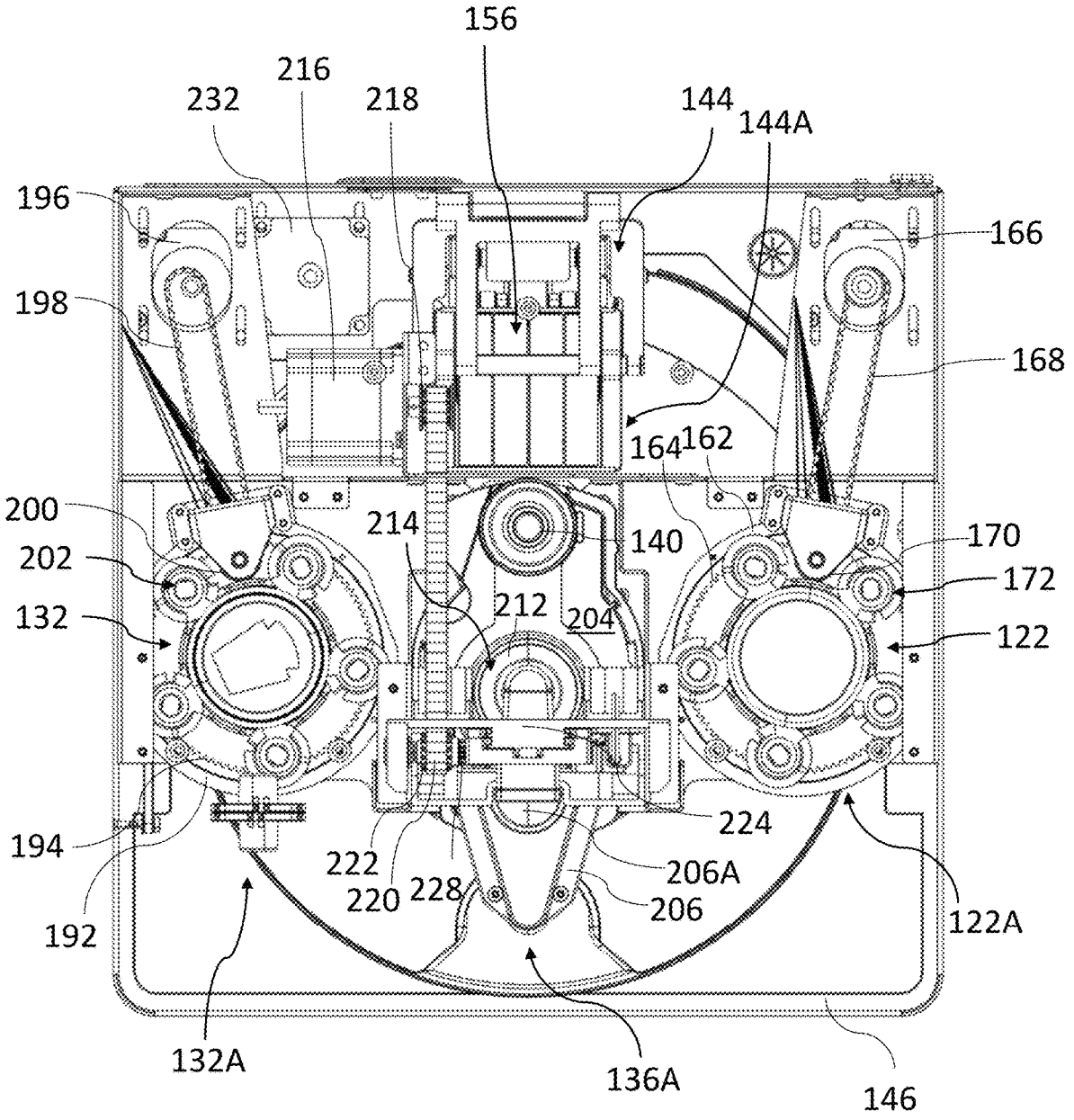
FIG. 5C is a top view of the condiment packaging apparatus of FIG. 1, shown without top covers, loading tubes, or the condiment cartridge.
Figure 5D:
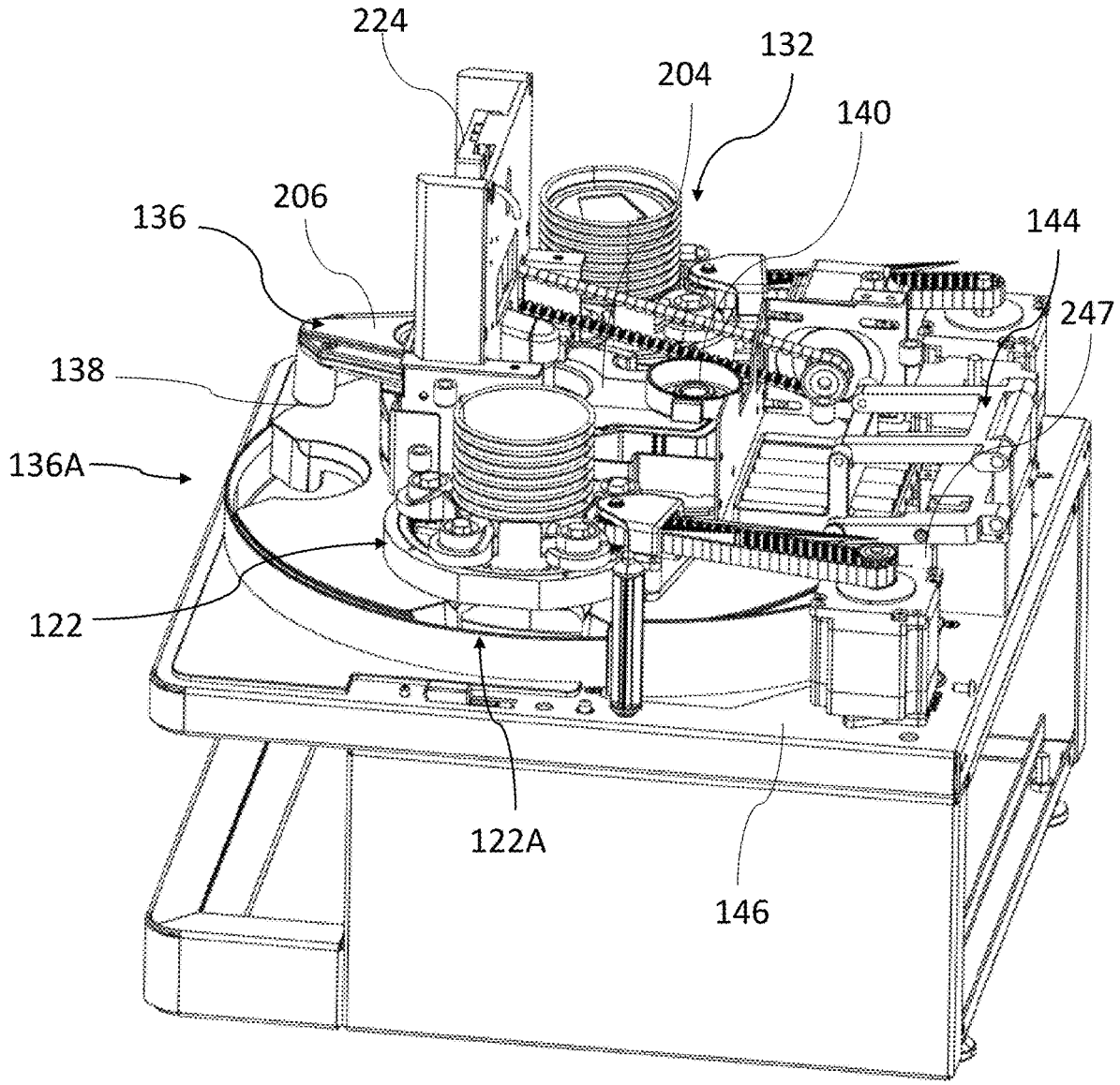
FIG. 5D is a rear perspective view of the condiment packaging apparatus of FIG. 1 shown without top covers, loading tubes, or the condiment cartridge.

With respect to FIGS. 5C-5D, and 7, the lid dispenser 132 operates similar to the cup dispenser 122 discussed above. The lid dispenser 132 likewise includes a disc 192, a gearwheel 194, a motor 196, a belt 198, a gear 200 (see FIG. 5C), and one or more screw members 202. The motor 196 may be operated to drive the belt 198 which causes the gear 200, gearwheel 194, and screw members 202 to rotate similar to the cup dispenser 122 to separate and dispense a single lid from the stack of lids onto a cup positioned at the lid dispensing station 132A.

The lid dispenser 132 may further include a sensor (e.g., a proximity sensor) that is used to detect whether there are any more lids in the stack of lids. Upon determining there are no more lids in the lid receiver 110, the condiment packaging apparatus 100 may provide a notification that the lids need to be refilled. For example, the condiment packaging apparatus 100 may include an indicator light (e.g., an LED) that is illuminated and/or flashes when the lids need to be refilled. The condiment packaging apparatus 100 may also send an alert to a remote computer, for example, a cash register or smartphone running an app, to alert the staff that the lids need to be refilled.

Figure 9:
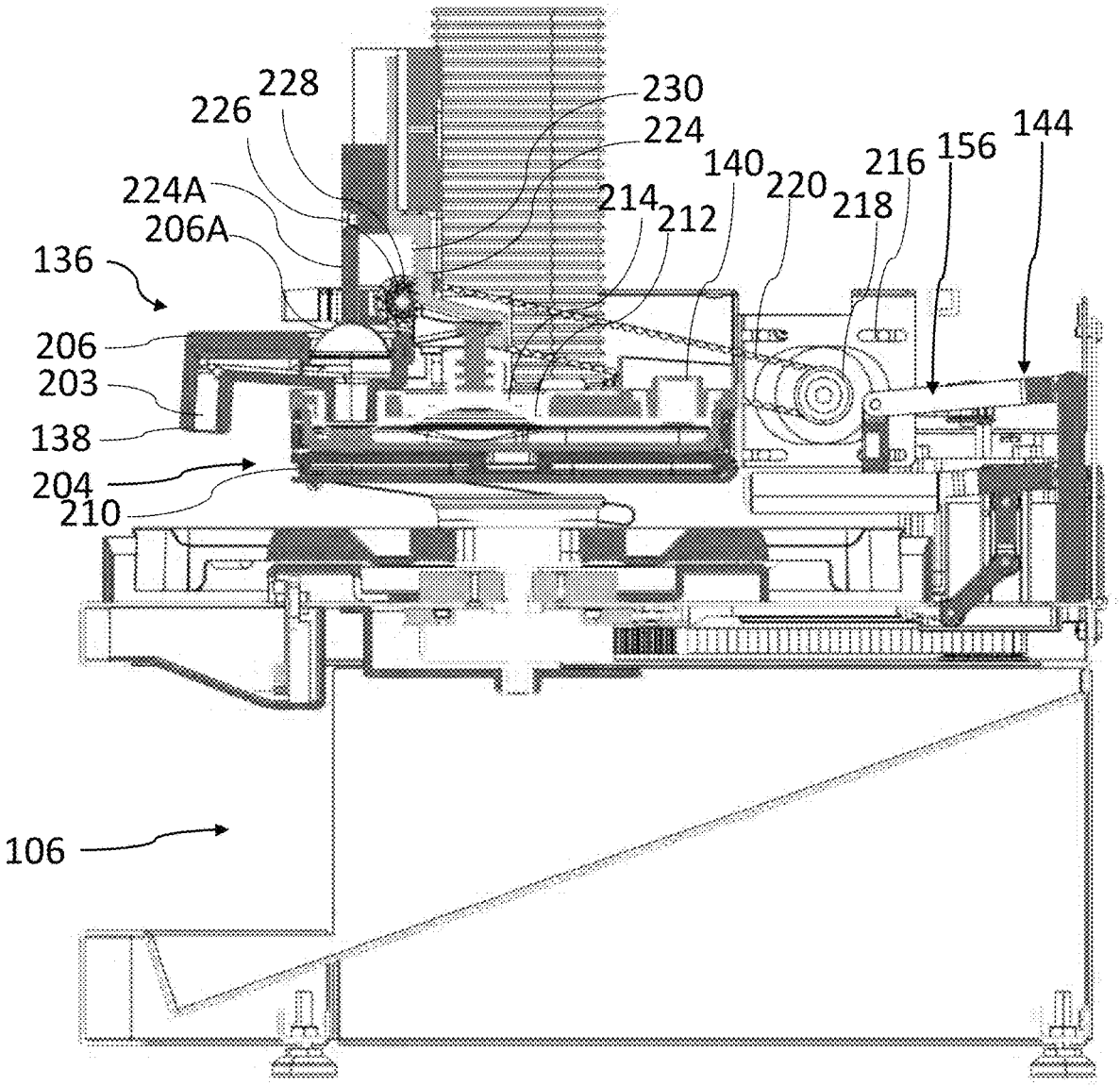
FIG. 9 is a cross-sectional view of the condiment packaging apparatus of FIG. 1 illustrating the fluid flow path through the fluid transfer system.

With respect to FIGS. 7 and 9, the fluid transfer system 136 includes a pump 204 and a spout such as fill tube 206. The fluid transfer system 136 is operable to pump fluid along a flow path 203 from the inlet 140 to the outlet 138 of the fluid transfer system 136 to fill cups 118 with condiment. The pump 204 includes a pump tray 210 having a membrane 212 that includes a diaphragm portion 214 that is moved in a reciprocating motion, or upward and downward, to increase and decrease the volume within a pumping chamber of the pump tray 210. As the membrane 212 moves upward, the volume of the pumping chamber increases which draws fluid from the cartridge 134 and into the pumping chamber. As the membrane 212 is moved downward, the volume of the pumping chamber decreases which forces the fluid in the pumping chamber toward the pump outlet and through the fill tube 206. The pump tray 210 forces the fluid along the fill tube 206 which causes fluid to be dispensed out the dispensing outlet 138 of the fill tube 206 when fluid fills the length of the fill tube 206. The cartridge 134 may include a one-way valve to prevent fluid from returning into the cartridge 134 when the volume of the pumping chamber is decreased due to the downward movement of the membrane 212. Likewise, the pump outlet of the pump tray 210 may include a one-way valve to prevent fluid from being drawn from the fill tube 206 when the volume of the pumping chamber is increased due to the upward movement of the membrane 212.

The fill tube 206 may include a bellows 206A that may be compressed and released to aid in expelling the condiment from the fill tube 206. The bellows 206A bubbles or extends outward from the fill tube 206. The bellows 206A may be formed of a semi-flexible material such as rubber, silicon, or polyurethane and the like such that the bellows 206A may be pressed or flexed inward toward the fill tube but returns to its normal shape extending from the fill tube 206 when force is removed. For example, the piston 224 may have a plunger portion 224A that presses the bellows 206A inward as the piston 224 is moved downward. Pressing the bellows 206A inward reduces the volume in the fill tube 206 which aids to force condiment out the outlet 138 and into the cups 118. As the piston 224 moves upward, the plunger portion 224A is withdrawn from the bellows 206A permitting the bellows 206A to expand. This expansion increases the volume in the fill tube 206 which draws the condiment from the outlet 138 back into the fill tube 206. Drawing the condiment from the outlet 138 aids in preventing condiment from dripping from the outlet 138 between cups 118 or when condiment is not intended to be dispensed.

The fluid transfer system 136 may include a motor 216 or other actuator (e.g., a solenoid, linear actuator) that drives the membrane 212 upward and downward to pump fluid through the pump from the cartridge 134 and through the fill tube 206. The motor 216 may include a shaft that is coupled to a first pulley 218. The motor 216 is configured to rotate the shaft which causes the pulley 218 to rotate. A belt 220 extends about the first pulley 218 and a second pulley 222 that is mounted proximate to a reciprocating member or piston 224. The belt 220 may be made of a rubber material, for example, a reinforced rubber. The belt 220 is secured about the first pulley 218 and the second pulley 222 such that rotation of the first pulley 218 by the motor 216 causes the second pulley 222 to rotate. A belt tensioner may be configured to engage the belt 220 to ensure the belt 220 is sufficiently engaging the first pulley 218 and the second pulley 222 to mitigate slippage of belt 220 relative to the pulleys 218, 222. The second pulley 222 is coupled to a shaft 226 that includes pinion gears 228 coupled thereto. The second pulley 222 is rigidly coupled to the shaft 226 such that rotation of the second pulley 222 by the motor 216 causes the shaft 226 to rotate. The pinion gears 228 are positioned along the shaft 226 to engage a rack or linear gear 230 on the reciprocating member or piston 224. As the pinion gears 228 are rotated, the pinion gear 228 engages the linear gear 230 to move the piston 224 upward or downward. During a pumping operation, a processor 356 is configured to operate the motor 216 to cycle between operation in a forward and reverse direction. This causes the pinion gear 228 to drive the piston 224 upward and downward cyclically or in a reciprocating motion which causes condiment to be pumped from the cartridge 134 to the outlet 138. Further details regarding the cartridge 134, the pump tray 210, and actuator systems can be found in PCT/US2022/036165, filed Jul. 6, 2022, which is incorporated by reference herein in its entirety.

The pump 204 and fill tube 206 may be withdrawn from the condiment packaging apparatus 100 as a single unit by removing the cartridge 134 and pulling the pump 204 and fill tube 206 forward along a track 207 the pump 204 rests upon and is able to slide along. Sliding the pump 204 forward disconnects the pump 204 from the piston 224. Thus, the entire fluid flow path 203 the condiment flows along from the condiment cartridge 134 to the cup 118 may be quickly removed from the condiment packaging apparatus 100. The pump 204 and fill tube 206 may then be disassembled and cleaned, for example, by placing them in a dishwasher for cleaning. Once cleaned, the fill tube 206 may be connected to the pump 204 and slid along the track 207 to reattach the pump 204 to the piston 224. A cartridge 134 may be connected to the pump 204 and the condiment packaging apparatus 100 operated to dispense closed condiment containers 160.

Figure 10:
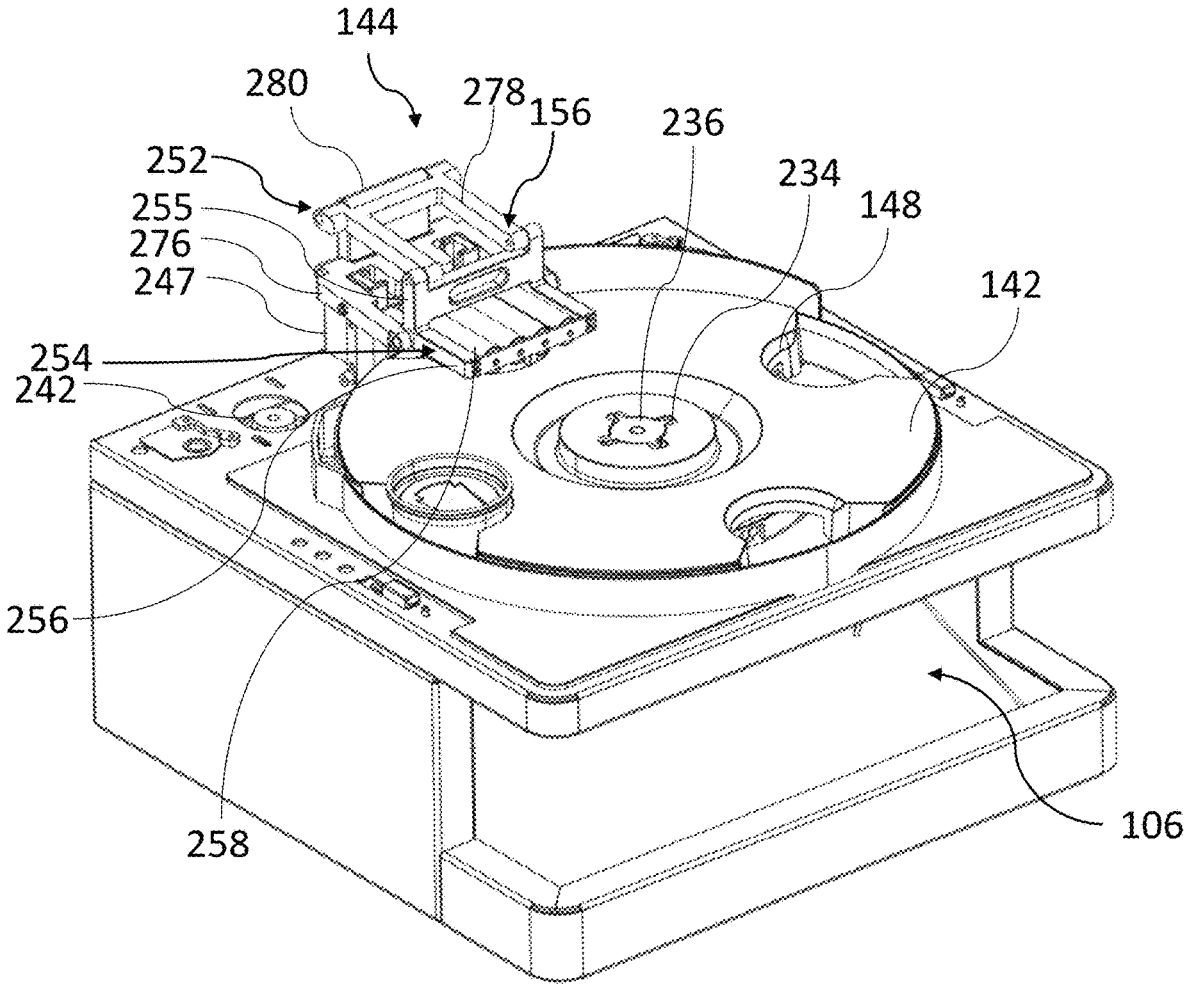
FIG. 10 is a top perspective view of a lower portion of the condiment packaging apparatus of FIG. 1 showing the turntable and a lid presser.
Figure 11A:
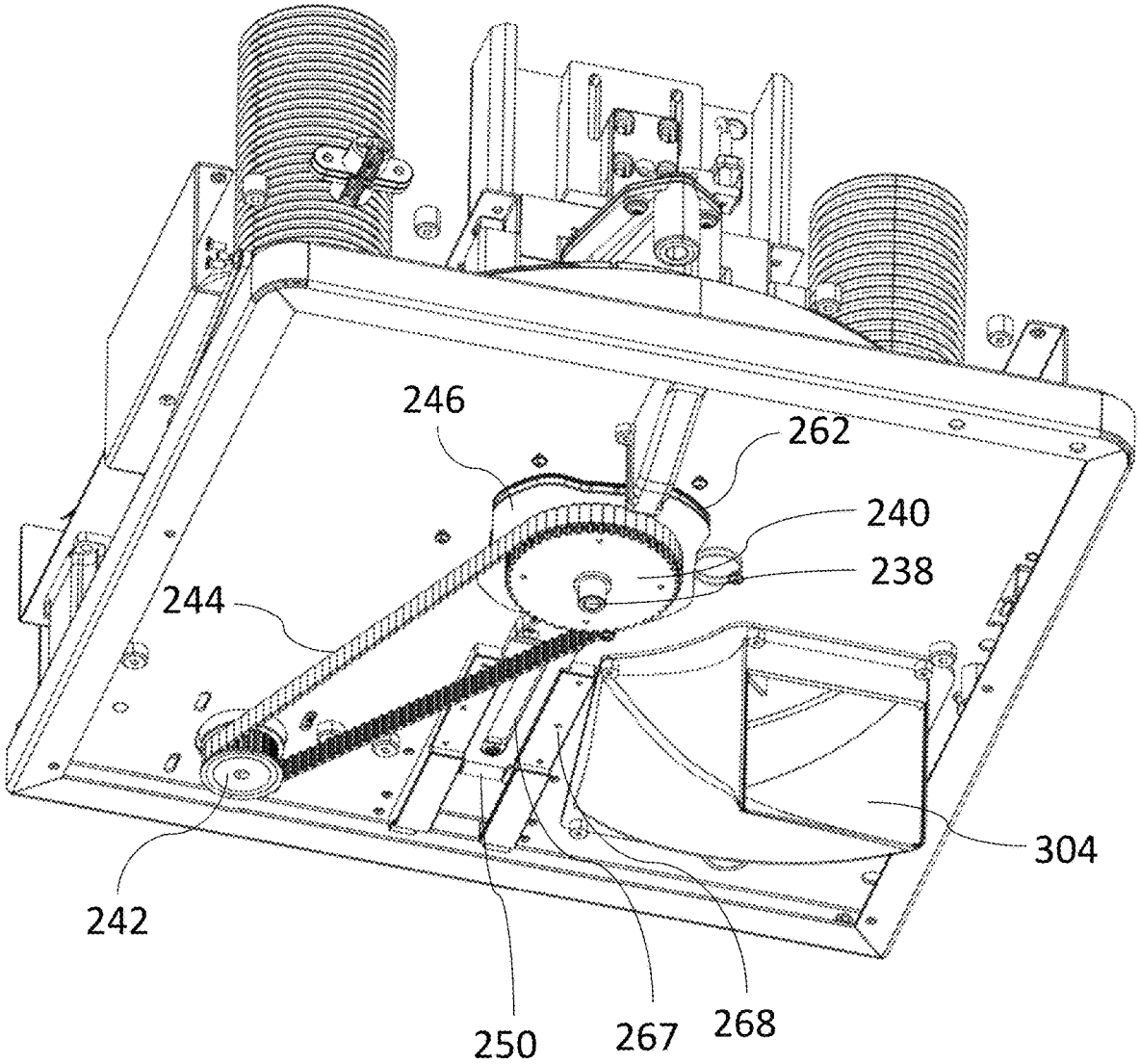
FIG. 11A is a bottom perspective view of a platform the condiment packaging apparatus of FIG. 1 showing a drive mechanism of the turntable and the lid presser.
Figure 11B:
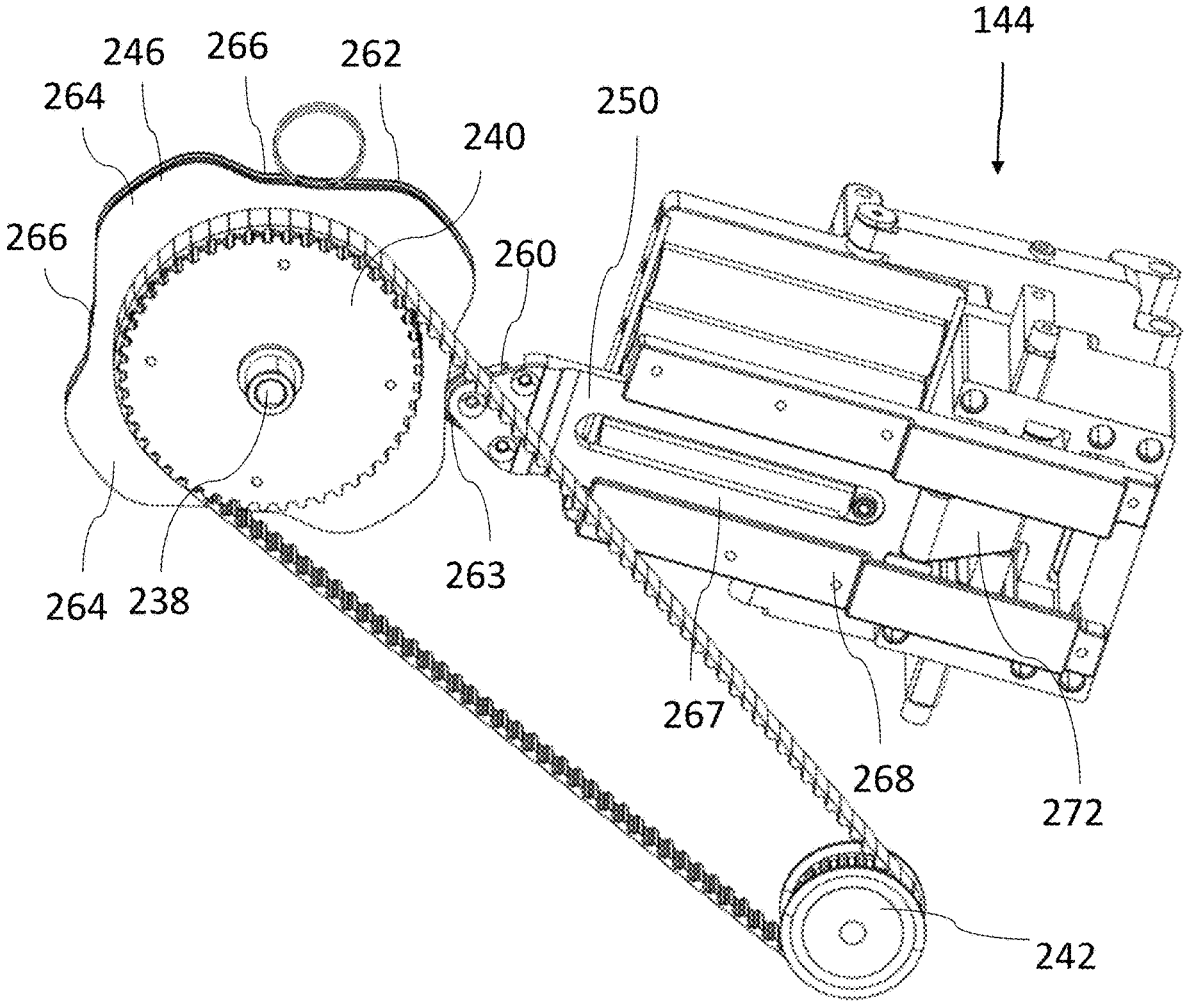
FIG. 11B is a bottom perspective view of the drive mechanism of the turntable and lid presser of FIG. 11A.
Figure 11C:
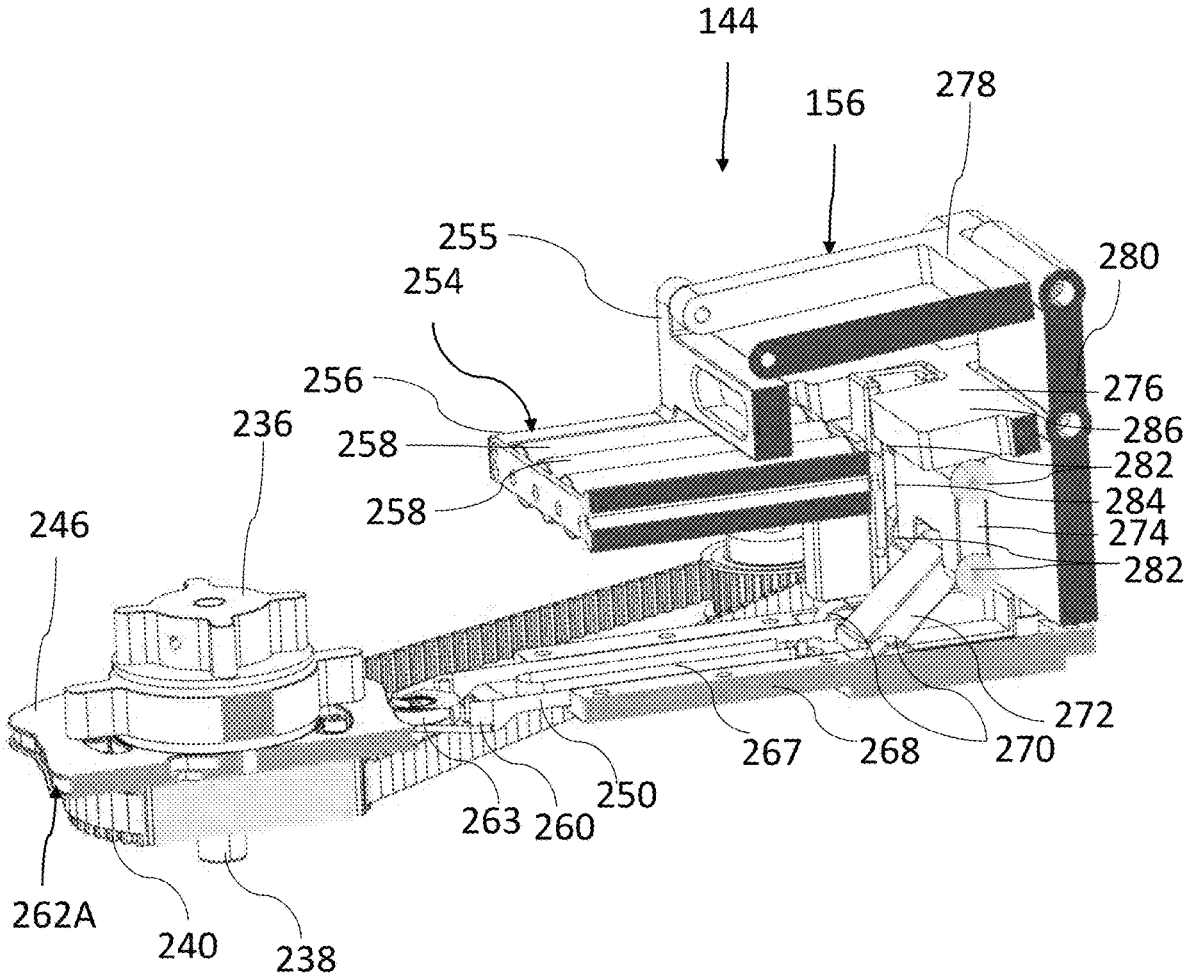
FIG. 11C is a top perspective, cross-sectional view of the drive mechanism and lid presser of FIG. 11A.
Figure 11D:
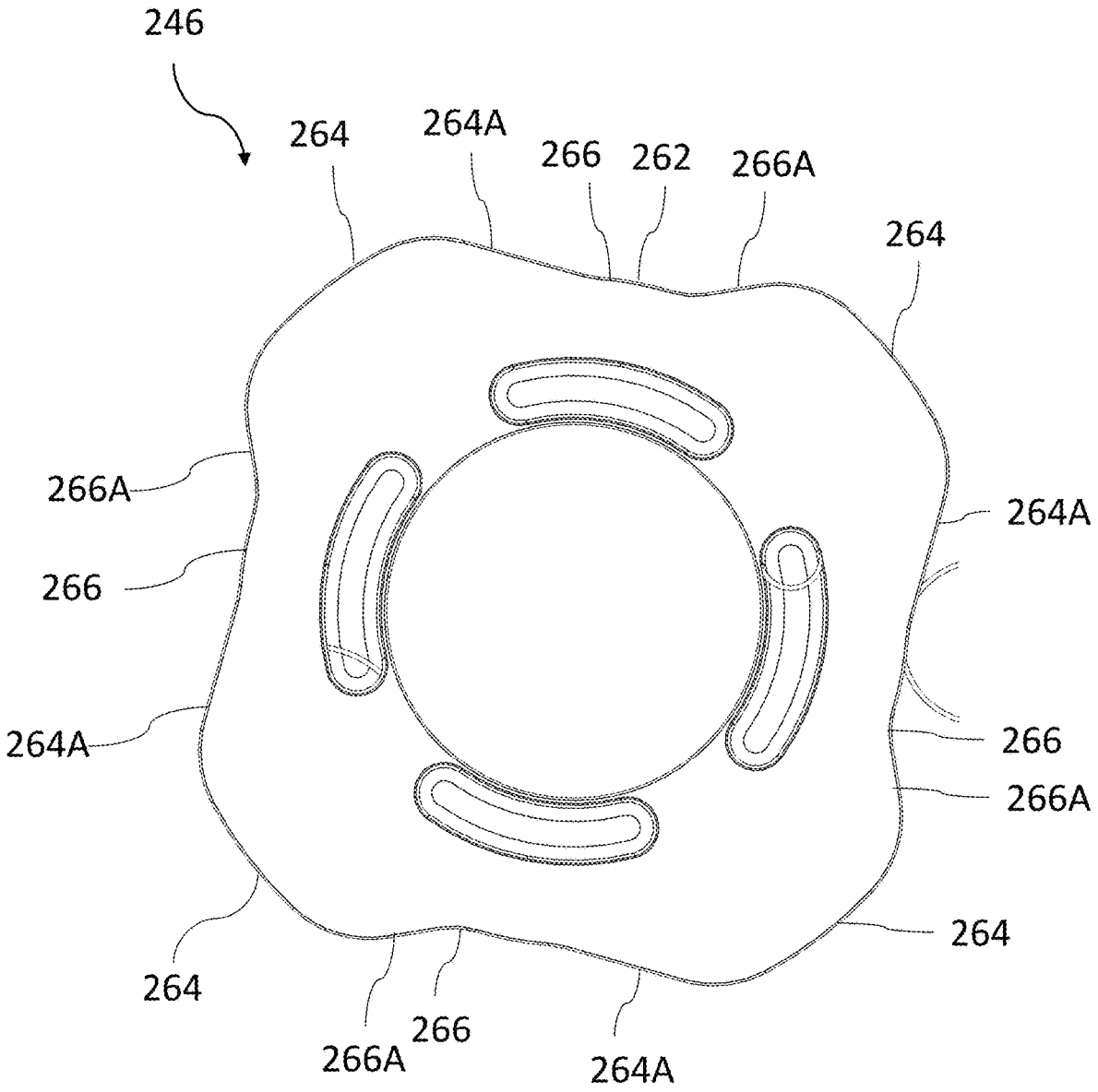
FIG. 11D is a top plan view of a camwheel of the condiment packaging apparatus of FIG. 1.

With respect to FIGS. 10-11A, the turntable 142 may be rotated by a motor 232 (see FIG. 5C). The turntable 142 may include a drive socket 234 that receives a drive head 236 (see FIG. 4B). The drive head 236 may be aligned with the drive socket 234 of the turntable 142 and the turntable 142 lowered onto the drive head 236 such that rotation of the drive head 236 rotates the turntable 142. The drive head 236 may be coupled to a shaft 238 that extends through the platform 146. A gear 240 and a camwheel 246 may also be coupled to the shaft 238 below the platform 146. The motor 232 may be coupled to the gear 240 such that operation of the motor 232 turns the gear 240 and thus the turntable 142. The motor 232 may be mounted on the platform 146 with a shaft extending downward and though the platform 146. A pulley 242 may be coupled to the shaft such that operation of the motor 232 rotates the pulley 242. A belt 244 may extend about the pulley 242 and the gear 240 such that operation of the motor 232 rotates the turntable 142. A controller may be configured to operate the motor 232 until one or more notches 148 of the turntable 142 are positioned at the stations 122A, 132A, 136A, and 144A. For example, the condiment packaging apparatus 100 may include a sensor that monitors the position of the turntable 142, gear 240, and/or camwheel 246 and stops the turntable 142 at each station. Once operation of one or more of the cup dispenser 122, fluid transfer system 136, lid dispenser 132, or lid presser 144 is complete, the controller may operate the motor 232 again to move the cups from station to station until the closed condiment container is formed and to eject the closed condiment container to the receptacle portion 106.

With respect to FIGS. 10-13B, the lid presser 144 includes the pressing arm 156, a drive leg 250, and a linkage 252 connecting the pressing arm 156 to the drive leg 250. The pressing arm 156 may be moved upward and downward to press a lid 128 onto a cup 118. The pressing arm 156 includes a support frame 254 that supports rollers 258. The rollers 258 are rotatably supported in the support frame 254 such that the rollers 258 may roll over the lid 128 as the lid 128 is pressed onto the cup 118. For example, the lid 128 may be pressed onto the cup 118 by the rollers 258 even while the turntable 142 rotates. This may provide additional time for the lid presser 144 to press the lid onto the cup without slowing down the process. The support frame 254 may include a side frame 256 extending about the rollers 258 to which the rollers 258 are rotatably coupled. The support frame 254 may further include a support portion 255 extending upward from the side frame 256.

The drive leg 250 includes an end portion 260 that travels along an outer edge 262 of the camwheel 246. The end portion 260 may include a roller or wheel 263 that travels along the outer edge 262. The wheel 263 may reduce the resistance between the drive leg 250 and the camwheel 246 as the drive leg 250 travels along the camwheel 246. The outer edge 262 may define a track 262A (see FIG. 11C) that aids to keep the wheel 263 aligned with and in engagement with the camwheel 246. The outer edge 262 of the camwheel 246 includes protrusions 264 spaced apart by recesses 266 (see FIGS. 11B and 11D). The end portion 260 of the drive travels is biased into engagement with the outer edge 262 of the camwheel 246 by a biasing member 247 (e.g., a spring) such that rotation of the camwheel 246 causes the drive leg 250 to move outward as the end portion 260 travels over a protrusion 264 and to move inward as the end portion travels over a recess 266. The drive leg 250 includes a leg portion 267 extending from the end portion 260 along a track 268. The leg portion 267 may be coupled to wheels 270 that roll along the track 268 to facilitate movement of the drive leg 250 between its inward and outward positions.

The linkage 252 connects the drive leg 250 to the pressing arm 156 and converts the horizontal movement of the drive leg 250 to vertical movement of the pressing arm 156. The linkage 252 includes a first transfer member 272, a second transfer member 274, a lower support arm 276, an upper support arm 278, and a connecting plate 280. The first transfer member 272 is pivotally connected to the drive leg 250 and pivotally connected to the second transfer member 274. The second transfer member 274 includes wheels 282 that roll along a track 284. The wheels 282 may reduce the force required to move the second transfer member 274 along the track 284. The track 284 extends substantially vertically such that the track 284 guides the second transfer member 274 upward and downward 274. The first transfer member 272 extends at an oblique angle from the drive leg 250 to the second transfer member 274. Thus outward movement of the drive leg 250 pushes the first transfer member 272 against the second transfer member 274 to drive the second transfer member 274 upward along the track 284. As the drive leg 250 moves inward (due to the force of the biasing member), the drive leg 250 pulls the first transfer member 272 inward which pulls the second transfer member 274 downward along the track 284.

The lower support arm 276 includes a frame that is pivotally connected to the connecting plate 280 and pivotally connected to the side frame 256 of the pressing arm 156. One or more biasing members 247 may be attached between the lower support arm 276 (see 5D and 10) and the platform 146. As shown, a biasing member 247 is attached to each side of the lower support arm 276. The biasing members 247 bias the lower arm 276 and thus the pressing arm 156 downward and toward the platform 146 to press the lids onto the cups when the lower support arm 276 is not driven upward by the drive leg 250 against the force of the biasing members 247. The lower support arm 276 includes a pressing plate 286 against which the second transfer member 274 presses when the second transfer member 274 is driven upward along the track 284 by the drive leg 250 passing over a protrusion 264. The second transfer member 274 applies force to the pressing plate 286 pivoting the lower support arm 276 about the connection with the connecting plate 280 and lifting the pressing arm 156 to the raised position against the biasing force of the biasing members 247. As the second transfer member 274 moves downward along the track 284, the lower support arm 276 is lowered by the force of the biasing members 247 which lowers the pressing arm 156 to its lowered position. The upper support arm 278 includes a frame that is pivotally connected to the connecting plate 280 above the lower support arm 276 and pivotally connected to the support portion 255 of the pressing arm 156 above the rollers 258. The upper support arm 278 aids to maintain the orientation of the pressing arm 156 as the lower support arm 276 moves the pressing arm 156 between its raised and lowered positions. For example, the upper support arm 278 holds the rollers 258 substantially horizontal, for example, by holding the support portion 255 substantially vertical as the pressing arm 156 is raised and lowered.

The camwheel 246 includes four protrusions 264 and four recesses 266 such that the end portion 260 is raised and lowered (to receive and press a lid onto a cup) four times during a rotation of the turntable 142. The number of protrusions 264 and recesses 266 may correspond to the number of cup receiving portions or notches 148 the turntable 142 has such that every time a lid and cup pass to the lid pressing station 144A, the pressing arm 156 is lowered to press the lid onto the cup.

Figure 12A:
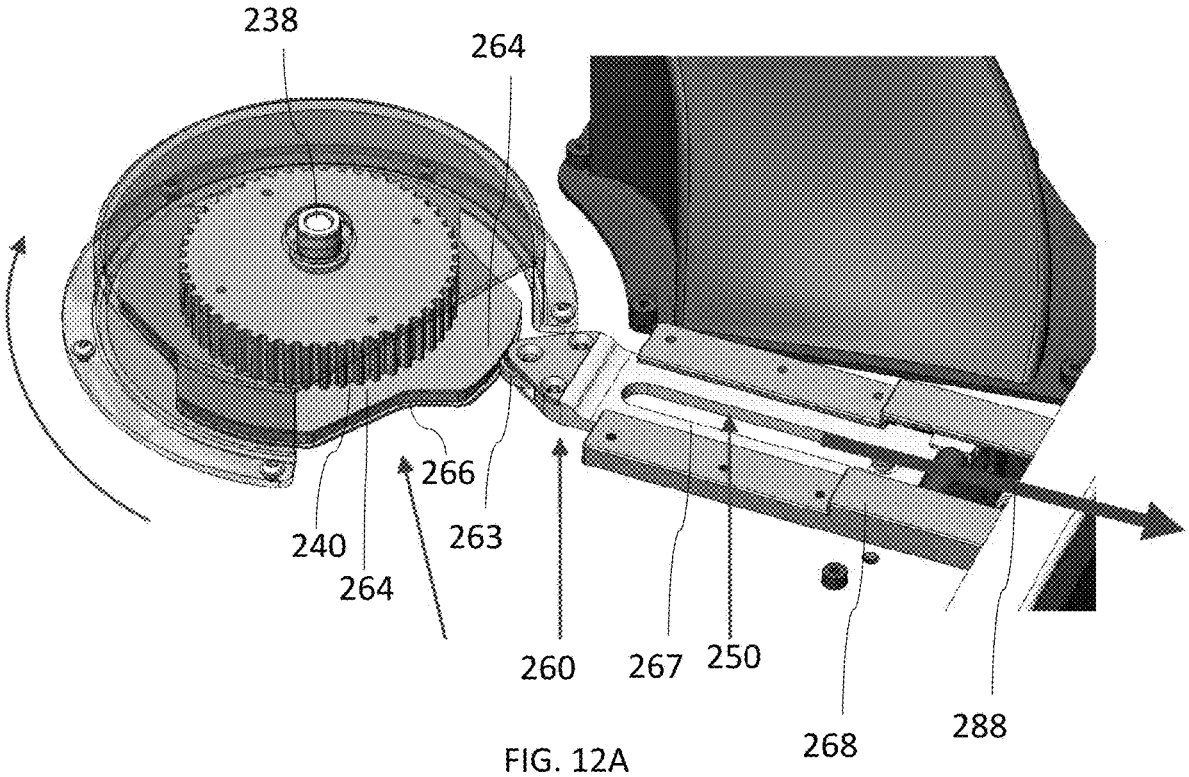
FIG. 12A shows the camwheel of the condiment packaging apparatus of FIG. 1 and a leg of the lid presser in a first configuration.
Figure 12B:
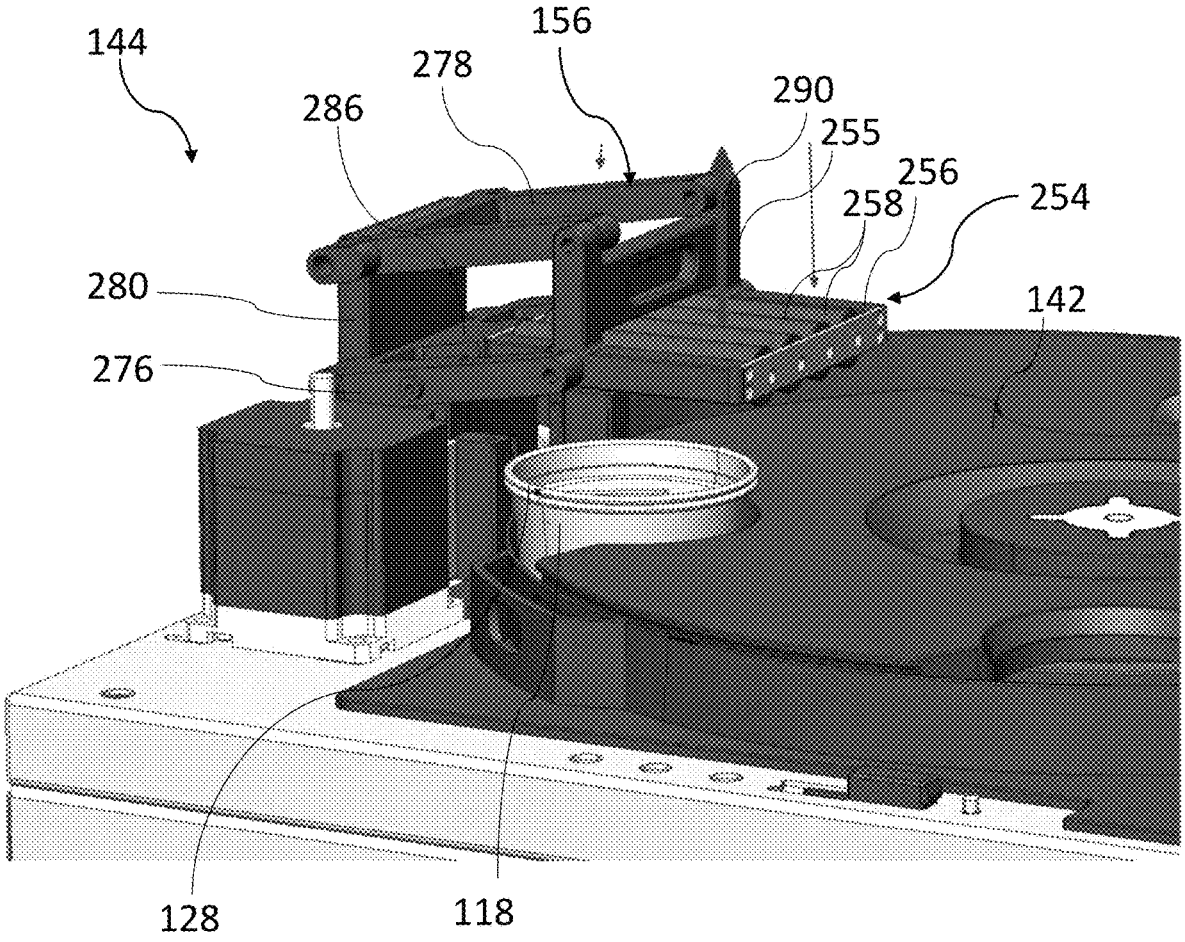
FIG. 12B shows the pressing arm of the lid presser of the condiment packaging apparatus of FIG. 1 in a raised position.
Figure 13A:
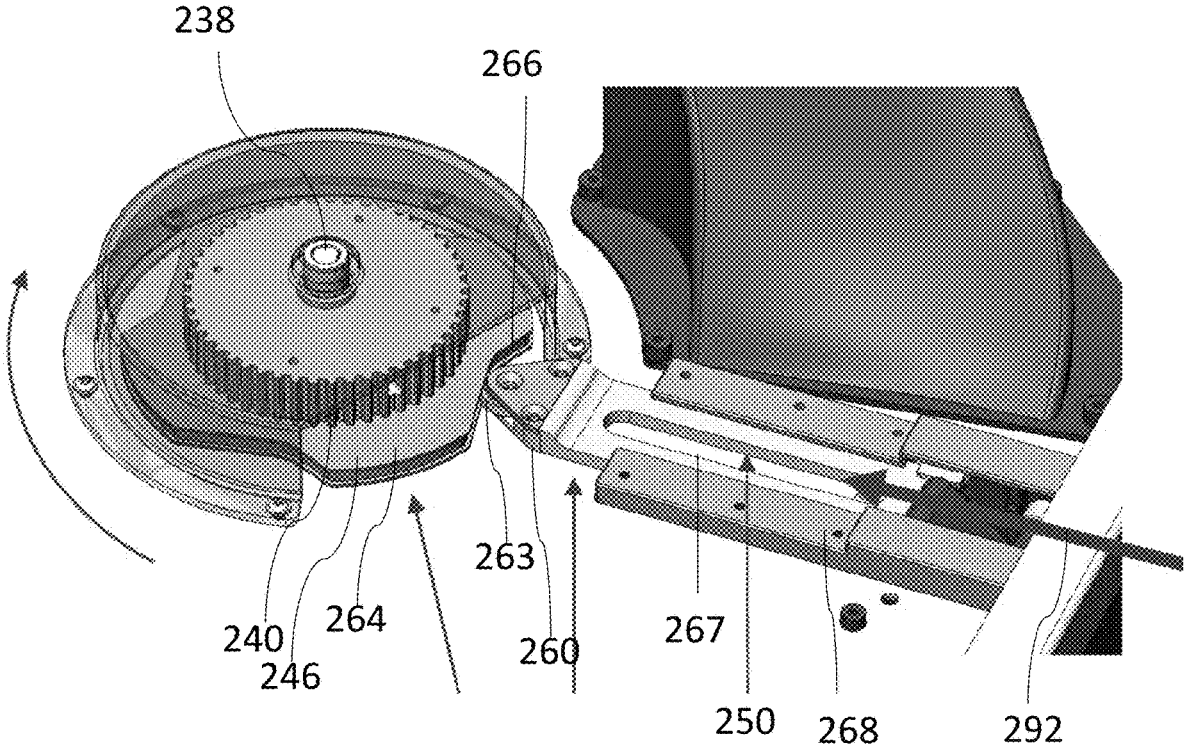
FIG. 13A shows the camwheel of the condiment packaging apparatus of FIG. 1 and the leg of the lid presser in a second configuration.
Figure 13B:
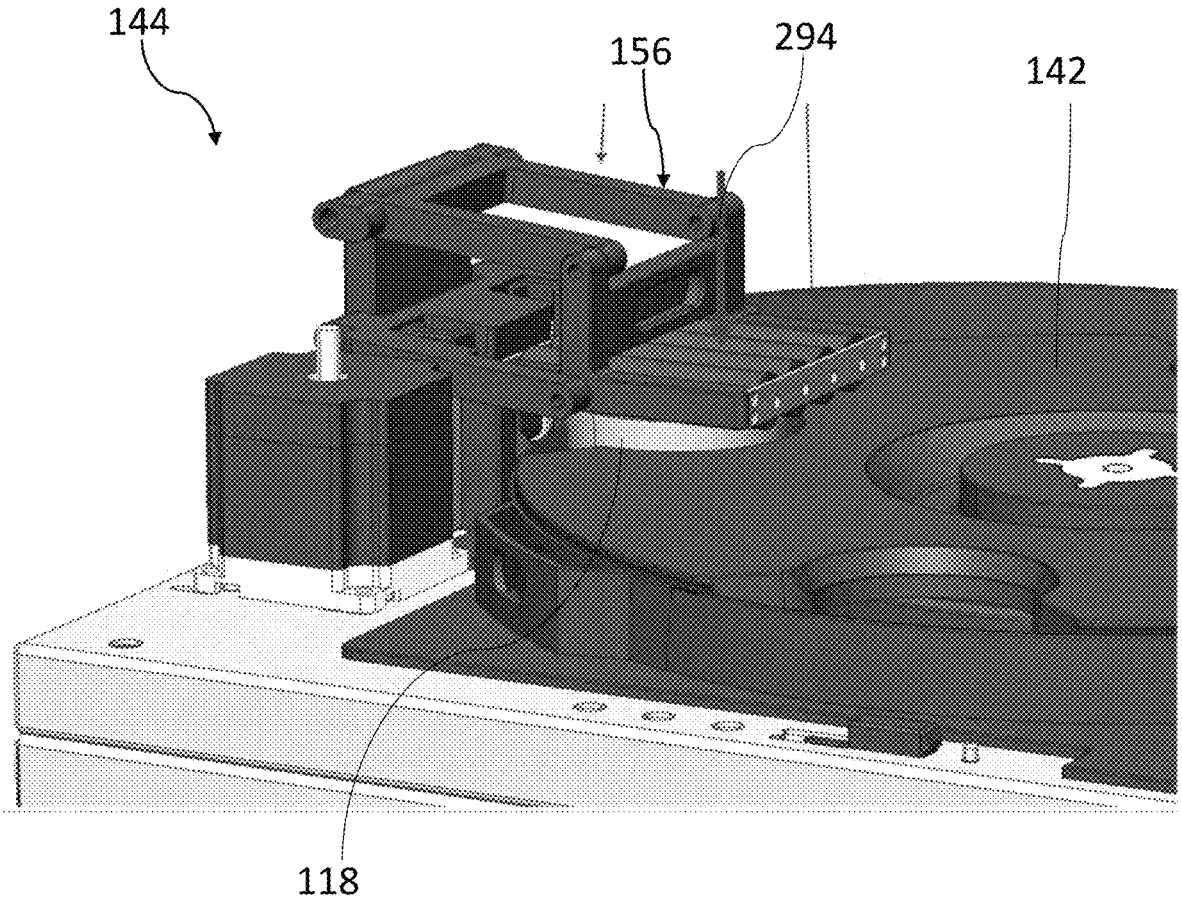
FIG. 13B shows the pressing arm of the lid presser of the condiment packaging apparatus of FIG. 1 in a lowered position.

With reference to FIGS. 12A-12B, when the end portion 260 of the drive leg 250 is engaging a protrusion 264 of the camwheel 246, the drive leg 250 is moved toward the outward position in direction 288 which causes the pressing arm 156 to be moved to the raised position in direction 290. In the raised position, a cup 118 and lid 128 are able to be positioned below the pressing arm 156 by rotation of the turntable 142. With reference to FIG. 13A-13B, when the end portion 260 of the drive leg 250 is engaging a recess 266 of the camwheel 246, the drive leg 250 is moved toward the inward position in direction 292 (e.g., by the force of the biasing member) which causes the pressing arm 156 to be moved to the lowered position in direction 294 by the biasing members 247 as discussed above. As the pressing arm 156 is moved to the lowered position, the pressing arm 156 engages the lid 128 which presses the lid 128 onto the cup 118. The leading edge of the recess 266A along which the drive leg 250 travels may extend radially more gradually than the leading edge 264A of the protrusion 264 (see FIG. 11D). Such a configuration causes the pressing arm 156 to be lowered more slowly when pressing the lids 128 onto the cups 118 than when the pressing arm 156 is raised off of lids. In other words, leading edge 264A of the protrusions 264 cause the pressing arm 156 to be lifted more abruptly off of the lids 128 than the pressing arm 156 is lowered onto the lids 128. This permits a constant, gradual pressure to be applied when pressing the lids 128 onto the cups 118 which avoids, for example, crushing the cup or the lid, but allows the pressing arm 156 to be lifted from the closed condiment container 160 quickly to permit the closed condiment container 160 to be ejected down the ramp 304 as discussed below.

Use of the camwheel 246 aids in coordinating the timing of the operations of the lid presser 144, cup dispenser 122, fluid transfer system 136, and lid dispenser 132. For example, the camwheel 246 may be configured to mechanically time the operation of the lid presser 144 to press a lid onto a cup at the same time as a cup is being dispensed into a notch 148, condiment is filled into a cup, and a lid is dispensed onto the cup. Because all of these operations can happen substantially simultaneously, the turntable 142 does not need to be separately stopped to perform one or more of these operations which increases the speed at which the condiment packaging apparatus 100 is able to output closed condiment containers 160. For instance, when the turntable 142 stops to fill a cup with condiment at the fluid transfer system 136, the lid presser 144 may be lowered to press a lid onto a cup positioned at the lid presser 144. In some forms, when a lid has been dispensed onto the last cup of a batch of closed condiment containers, the turntable 142 may not stop at the lid presser 144 because the turntable 142 does not need to stop to dispense a cup, lid, or condiment at the other stations. In some forms, the turntable 142 rotates continuously and does not stop to dispense the cups, lids, fill the cups with condiment, or to press the lid onto the cup. The rollers 258 of the lid presser 144 enable the lid to be pressed onto the cup while the cup is rotated by the turntable 142.

Figure 14:
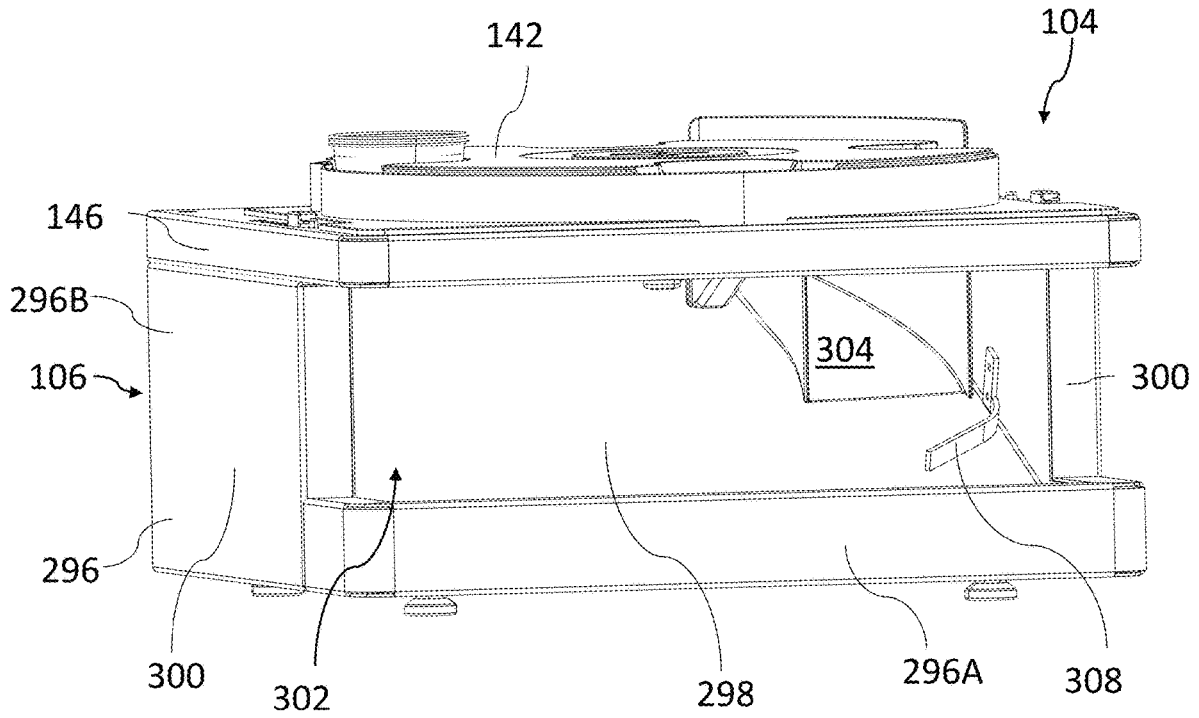
FIG. 14 is a front perspective view of a receptacle portion of the condiment packaging apparatus of FIG. 1 showing a ramp extending from the packaging portion to a receptacle.

With respect to FIG. 14, the receptacle portion 106 includes a base 296 on which the packaging portion 104 is mounted. The base 296 includes a bottom 298 and sidewalls 300 that extend upward from the bottom 298 to form a receptacle 302. The bottom 298 may be sloped to direct the closed condiment containers 160 toward the front of the receptacle 302 where they may be retrieved. The sidewalls 300 support the packaging portion 104 above the receptacle 302 such that the packaging portion 104 may dispense closed condiment containers 160 into the receptacle 302 where a worker may retrieve the closed condiment container 160. The front portion 296A of the base 296 may extend forward further than the platform 146 and/or the sidewalls 300 may be shorter than the rear portion 296B of the base 296 to provide access to the closed condiment containers 160 in the receptacle 302.

The base 296 may further include a ramp 304 that extends from the packaging portion 104 and along the bottom 298 of the base 296 to guide closed condiment containers 160 from the packaging portion 104 into the receptacle 302. With reference also to FIG. 4A-4B, an upper portion 306 of the ramp 304 may align with the track 149 along which the cups 118 are slid along by the turntable 142. When the closed condiment container 160 is rotated beyond the lid pressing station 144A by the turntable 142, the closed condiment container 160 is rotated over the upper portion 306 of the ramp 304. The closed condiment container 160 then slides along the ramp 304 and downward into the receptacle 302. The inner guide wall 150 of the track 149 may have a protrusion portion 150A that sweeps outward as the track extends beyond the lid pressing station 144A to direct the closed condiment container 160 outward, out of the open end of the notch 148, and to the ramp 304 as the turntable 142 rotates. The receptacle 302 may include a guide wall 308 extending from the ramp 304 to direct the closed condiment containers toward the middle of the receptacle 302.

Figure 15:
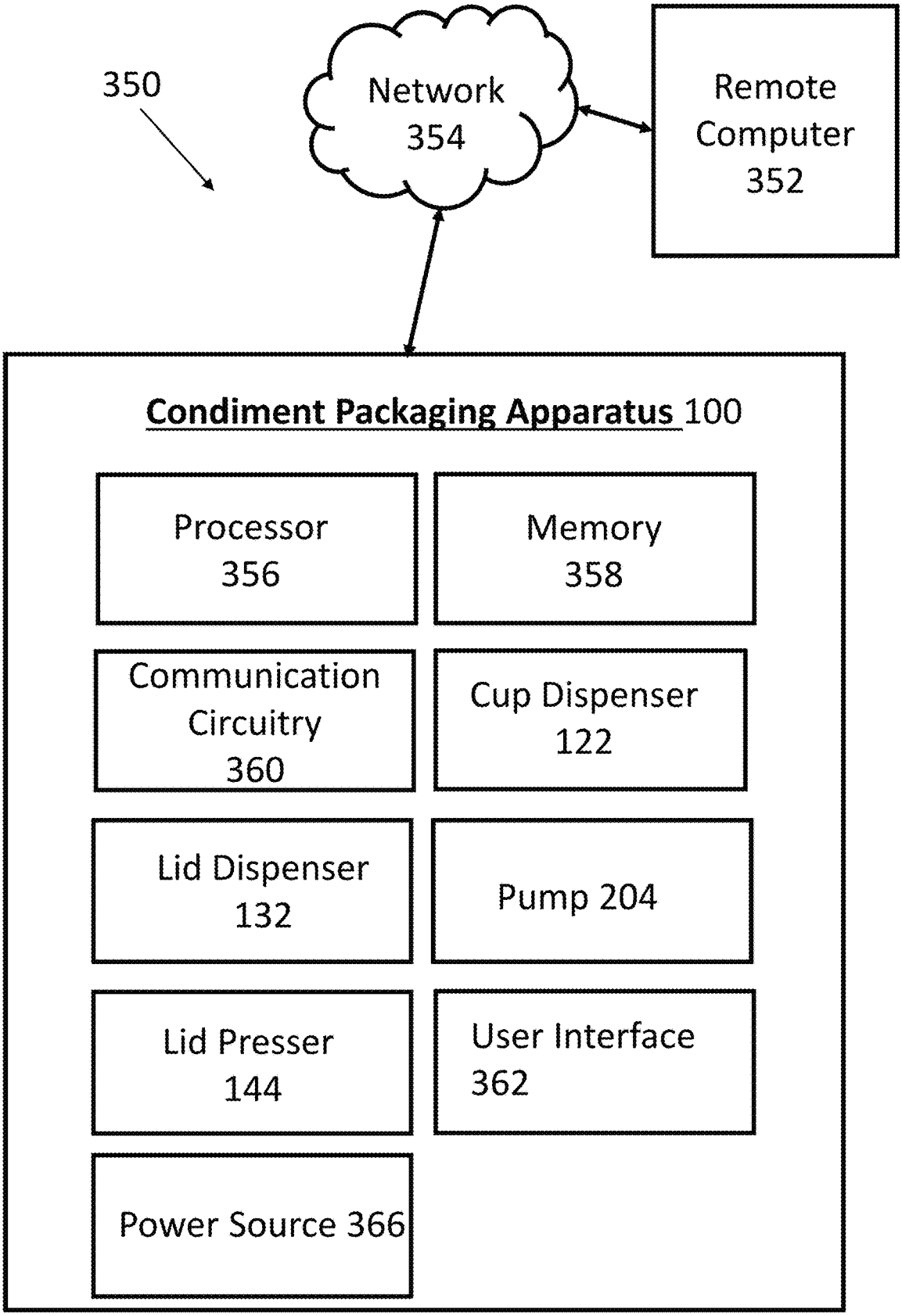
FIG. 15 is a block diagram of a condiment packaging system including the condiment packaging apparatus of FIG. 1.

With reference to FIG. 15, a condiment packaging system 350 is shown including the condiment packaging apparatus 100, a remote computer 352, and a network 354. The condiment packaging apparatus 100 includes a processor 356 and memory 358. The memory 358 may include programs and instructions for carrying out various operations and providing functionality to the condiment packaging apparatus 100. For example, the memory 358 may include instructions for operating the cup dispenser 122, fluid transfer system 136, lid dispenser 132, lid presser 144, and turntable 142. For instance, the memory 358 may store data regarding how long to operate the motor 232 of the turntable 142 to rotate a cup 118 from one station to the next and when to operate the cup dispenser 122 and lid dispenser 132 to dispense a cup 118 or lid 128. The memory 358 may also store information relating to how long to operate the pump 204 of the fluid transfer system 136 to dispense a certain amount the condiment into the cup 118. The memory 358 may also store data regarding how much condiment has been dispensed from a cartridge and/or how many closed condiment containers have been made. The processor 356 may determine how much condiment is left in the cartridge 134 by tracking the number of closed condiment containers that have been filled since a full cartridge was installed. The processor 356 may control the motors 166, 196, 216, 232 of the cup dispenser 122, lid dispenser 132, pump 204, turntable 142, and/or lid presser 144 to fill, close, and dispense a container filled with condiment. The processor 356 is configured to communicate with the memory 358 to access the programs and instructions to provide functionality to the condiment packaging apparatus 100 as described in further detail below with respect to FIG. 16.

The condiment packaging apparatus 100 further may include communication circuitry 360. The processor 356 may use the communication circuitry 360 to communicate with remote devices. For example, the communication circuitry 360 may be configured to communicate via wired and wireless communication protocols including, as examples, cellular, Wi-Fi, Bluetooth, NFC, Zigbee, ethernet, and the like. The processor 356 may communicate signals via the communication circuitry 360 to remote devices and receive signals from remote devices via the communication circuitry 360. The condiment packaging apparatus 100 may be configured to communicate with the remote computer 352 (e.g., a server computer) via the network 354 using the communication circuitry 360. The network 354 may include a cellular network, Wi-Fi network, and/or the internet as examples. The condiment packaging apparatus 100 may communicate data with the remote computer 352 such as whether the cup receiver 108 has any more cups, how many cups remain to be dispensed, whether the lid receiver 110 has any more cups, how many lids remain to be dispensed, how much condiment is left in the cartridge 134, and/or when the condiment packaging apparatus 100 should be cleaned (e.g., based on the length of time the condiment has been in the pump 204). The condiment packaging apparatus 100 and/or remote computer 352 may communicate with a user via the communication circuitry 360, for example a user device (e.g., a smartphone, tablet, personal computer, cash register, etc.) to alert a user or staff of a restaurant when the condiment cartridge 134, cups 118, and/or lids 128 are running low or has run out. The condiment packaging apparatus 100 may also receive a communication from the remote computer 352 to create a certain number of closed condiment containers. For example, upon receiving an order from a customer, a cash register may send a request to the condiment packaging apparatus 100 to fill a certain number of containers for the order.

The condiment packaging apparatus 100 may also alert the user or staff to errors and/or when the condiment packaging apparatus 100 should be serviced. The condiment packaging apparatus 100 and/or remote computer 352 may be associated with a smartphone application and information pertaining to the condiment packaging apparatus 100 may be presented to the user and/or viewable by a user in the smartphone application. A user may also be able to use the smartphone application (or other such program) to record the type of condiment the user has installed and the time/date when the condiment cartridge was installed. A user may also use the smartphone application (or similar program) to determine how much condiment is left in the condiment packaging apparatus 100, whether any cups 118 are left, how many cups are left, whether any lids 128 are left, how many lids are left, and/or when the condiment cartridge was installed. The user may also receive alerts from the condiment packaging apparatus 100 to refill or service the condiment packaging apparatus 100, for example, when the condiment cartridge, cups, and/or lids are running low.

The condiment packaging apparatus 100 may also include a user interface 362, for example, a series of buttons 364 and indicator lights that the user may operate to control operation of the condiment packaging apparatus 100 and/or enter information into or access information from memory 358 and/or the remote computer 352. For example, a user may press a button to turn the condiment packaging apparatus 100 on to begin dispensing closed condiment containers 160 to the receptacle 302. The user may press a button to indicate how many closed condiment containers to make (e.g., 10). The user may also press a button to indicate that the condiment cartridge 134 has just been replaced and/or has been serviced. In some forms, the user interface 362 of the condiment packaging apparatus 100 includes a touchscreen display. A user may also be able to access and enter such information using a smartphone application associated with the condiment packaging apparatus 100. The smartphone application may be associated with multiple condiment packaging apparatuses 100, for example, where the restaurant has a different condiment packaging apparatus for several condiment types, such as, for example, ketchup, mustard, and barbeque sauce.

The condiment packaging apparatus 100 may be powered by a power source 366. The power source 366 may include an electrical cord with a plug for attaching to a wall outlet to receive mains power. Alternatively or additionally, the power source 366 may include a battery. The battery may be replaceable and/or rechargeable. Powering the condiment packaging apparatus 100 with a battery increases the locations within a restaurant where the condiment packaging apparatus 100 may be placed. For example, the condiment packaging apparatus 100 need not be placed close to an electrical outlet. The condiment packaging apparatus 100 may be placed on an island within a kitchen that may, for instance, not have an electrical outlet.

The control box 107 may house the processor 356, memory 358, and/or communication circuitry 360. The control box 107 may be in a box separate from the condiment packaging apparatus 100 and communicatively coupled to the components of the condiment packaging apparatus 100 by wires and/or cables. In other forms, the components of the control box 107 are not in a separate box but integrated into the loading portion 102, packaging portion 104, and/or receptacle portion 106. The control box 107 may be separate from the remainder of condiment packaging apparatus 100 to reduce the size (e.g., height) of the condiment packaging apparatus, so that the user interface 362 is repositionable to an accessible location, and/or to keep the processor, memory, and communication circuitry 360 away from the condiment, for example, in the event of a spill.

The condiment packaging apparatus 100 provides a solution to providing customers with condiment they may take to-go in compostable packaging. The condiment packaging apparatus 100 is particularly suited for use in a kitchen of a restaurant being compact and easily cleanable. The condiment packaging apparatus 100 is compact in part due to its stacked configuration with the loading portion 102 on top of the packaging portion 104 which is on top of the receptacle portion 106. The cups, lids, and condiment cartridge 134 may be quickly and easily loaded into the top of the loading portion 102. Stacking these portions of the condiment packaging apparatus 100 enables the condiment packaging apparatus 100 to have a smaller footprint and thus takes up less space on a countertop in the kitchen. The condiment packaging apparatus 100 is also compact because it moves the cup receiving portions in a loop, for example, using the turntable 142. The condiment packaging apparatus 100 is easily refillable. The cups and lids may be dropped down their respective loading tubes 120, 130 and the condiment cartridge 134 may quickly be removably attached to the cartridge receiver 112 of the loading portion 102 and the pump 204.

The condiment packaging apparatus 100 is also easily cleanable. As described above, the pump 204 and fill tube 206, which include the entire fluid flow path 203 from the condiment cartridge 134 to the dispensing outlet 138, can be removed as a single unit along a track which easily disconnects the pump 204 from the piston which drives the pump 204. The pump 204 and fill tube 206 can readily be disassembled and cleaned, for example, in a dishwasher. The pump 204 and fill tube 206 are easily accessible for removing and cleaning. For example, the access cover 147 may be pivoted upward to provide access to the fill tube 206 which may be grasped by the user and pulled forward along the track to remove the pump 204 and fill tube 206. The upper portion 141 of the condiment packaging apparatus 100 may also be pivoted upward from the lower portion 143 to provide access to the turntable 142. Providing access to the turntable 142 provides access to the entire process line of the condiment packaging apparatus 100. Thus, in the event of a spill or the packaging portion 104 of the condiment packaging apparatus 100 otherwise needs servicing, the user can pivot the upper portion 141 upward to access and service any portion of the processing line of the packaging portion 104 and/or withdraw the turntable 142 (e.g., for cleaning).

Figure 16:
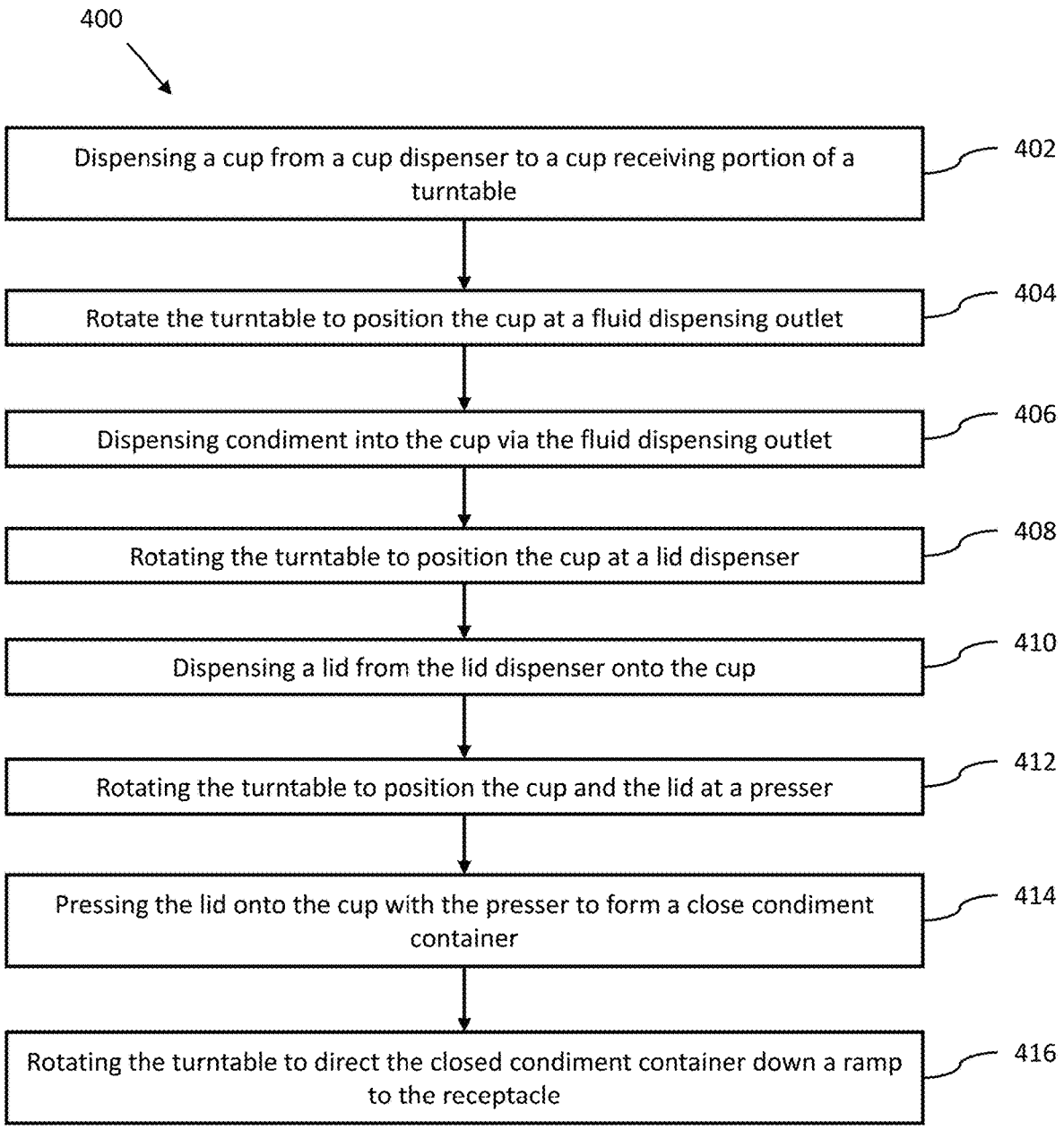
FIG. 16 is a flow diagram of a method of operation of the condiment packaging apparatus of FIG. 1

With respect to FIG. 16, a method 400 of operation of the condiment packaging apparatus 100 is provided when the condiment packaging apparatus 100 is loaded and ready to make closed condiment containers 160. For example, cups 118 are loaded into the cup receiver 108, the condiment cartridge 134 is filled and fluidly connected to the pump 204, and lids 128 are loaded into the cup receiver 108. The condiment packaging apparatus 100 may dispense 402 a cup 118 from the cup dispenser 122 to one of the cup receiving portions or notches 148 of the turntable 142. For example, the processor 356 may operate the motor 166 of the cup dispenser 122 to drop a cup 118 from the stack of cups.

The condiment packaging apparatus 100 may rotate 404 the turntable 142 to position the cup 118 at a fluid dispensing outlet 138. For example, the processor 356 may operate the motor 232 to cause the turntable 142 to rotate to position the cup receiving portion or notch 148 with the cup 118 at the fluid dispensing station 136A. The condiment packaging apparatus 100 may dispense 406 condiment into the cup 118 via the fluid dispensing outlet 138. For example, the processor 356 may operate the motor 216 to drive the piston 224 upward and downward to cause the pump 204 to pump a desired amount of condiment out the outlet 138 and into the cup 118.

The condiment packaging apparatus 100 may rotate 408 the turntable 142 to position the cup 118 at the lid dispenser 132. For example, the processor 356 may operate the motor 232 to cause the turntable 142 to rotate to position the cup receiving portion or notch 148 with the cup 118 at the lid dispensing station 132A. The condiment packaging apparatus 100 may dispense 410 a lid 128 from the lid dispenser 132 on to the cup 118. For example, the processor 356 may operate the motor 196 of the lid dispenser 132 to cause the lid dispenser 132 to drop a lid 128 from the stack of lids 128 onto the cup 118.

The condiment packaging apparatus 100 may rotate 412 the turntable 142 to position the cup 118 and the lid 128 at the lid presser 144. For example, the processor 356 may operate the motor 232 to cause the turntable 142 to rotate to position the cup receiving portion or notch 148 with the cup 118 and lid 128 at the lid pressing station 144A. The condiment packaging apparatus 100 may press 414 the lid 128 onto the cup 118 with the lid presser 114 to form a closed condiment container 160. For example, the operation of the motor 232 to cause the turntable 142 to rotate may also rotate a camwheel 246 that permits a pressing arm 156 to be forced against the lid 128 (e.g., by biasing member) to press the lid 128 on the cup 118. As another example, an actuator (e.g., a linear actuator or motor) may be operated to drive the pressing arm 156 against the lid 128 to press the lid 128 onto the cup 118.

The condiment packaging apparatus 100 may rotate 416 the turntable 142 to direct the closed condiment container 160 down the ramp 304 to the receptacle 302. For example, the turntable 142 may slide the closed condiment container 160 along a protrusion portion 150A of the track 149 that ejects the condiment contain 160 from the turntable 142 toward the ramp 304. The closed condiment container 160 may slide along the ramp 304 from the packaging portion 104 into the receptacle 302 below the packaging portion 104.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described particular embodiments of the present invention, those skilled in the art will recognize that a wide variety of modifications, alterations, and combinations can be made with respect to the above-described embodiments without departing from the scope of the invention, and that such modifications, alterations, and combinations are to be viewed as being within the ambit of the inventive concept.

What is claimed is:

1. A condiment dispenser comprising:

a condiment receiver for receiving a condiment;

a dispensing outlet;

a cup dispenser;

a ramp;

a receptacle; and a turntable having a cup receiving portion that receives a cup from the cup dispenser when the cup receiving portion is at the cup dispenser, wherein the turntable is rotatable to transfer the cup to the dispensing outlet where the condiment is dispensed into the cup, wherein the turntable is rotatable to direct the filled cup to the ramp along which is configured such that the cup slides downwardly to the receptacle positioned vertically below the turntable, wherein the condiment receiver and the cup dispenser are comprised within a loading portion, wherein the turntable is comprised by a lower portion, and wherein the loading portion is pivotably connected to the lower portion and is configured to be pivoted upward to provide access to a packaging portion.

2. The condiment dispenser of claim 1 further comprising a lid dispenser, wherein the turntable is rotatable to transfer the cup to the lid dispenser where a lid is positioned on the cup.

3. The condiment dispenser of claim 2 further comprising a lid presser, wherein the turntable is rotatable to transfer the cup and lid from the lid dispenser to the lid presser, the lid presser operable to press the lid onto the cup.

4. The condiment dispenser of claim 3 wherein the lid presser includes an arm including at least one roller, the arm movable between a lifted position and a lowered position, wherein rotation of the turntable drives the arm of the lid presser from the lifted position to the lowered position such that the arm and at least one roller presses the lid onto the cup.

5. The condiment dispenser of claim 1 further comprising a track surface along which the cup slides as the turntable rotates.

6. The condiment dispenser of claim 1 wherein the condiment receiver and cup dispenser are above the turntable, the condiment receiver and cup dispenser configured to be lifted upward and pivoted from the turntable to provide access to the turntable.

7. A condiment dispenser comprising:

a loading portion having a condiment receiver configured to be attached to a condiment cartridge containing condiment, a cup dispenser configured to receive at least one cup, and a lid dispenser configured to receive at least one lid;

a packaging portion including a turntable configured to be rotated by a motor, the turntable having a cup receiving portion configured to receive a cup from the cup dispenser, the turntable configured to be rotated by the motor to position the cup below a dispensing outlet fluidly coupled to the condiment cartridge, the turntable configured to be rotated by the motor to position the cup below the lid dispenser to receive a lid, and the turntable configured to be rotated by the motor to eject the cup; and a storage portion vertically below the packaging portion and having a cup receptacle receiving the cup ejected from the packaging portion, wherein the loading portion is above the packaging portion and pivotably connected to a portion of the packaging portion such that the loading portion is configured to be lifted and pivoted to provide access to the portion of the packaging portion.

8. The condiment dispenser of claim 7 further comprising a ramp extending at least in part vertically to the cup receptacle from a floor of the packaging portion on which the turntable rotates, the cup traveling along the ramp to the cup receptacle when ejected from the packaging portion.

9. The condiment dispenser of claim 8 wherein the floor includes an opening, wherein rotation of the turntable slides the cup along the floor to the opening through which the cup passes to the ramp.

10. The condiment dispenser of claim 7 wherein the packaging portion is stacked on the storage portion and the loading portion is stacked on the packaging portion.

* * * * *